US005237750A

United States Patent [19]

Nakano et al.

[11] Patent Number: 5,237,750

[45] Date of Patent: Aug. 24, 1993

[54] HAIR CLIPPER

[75] Inventors: Ryuichi Nakano, Hikone; Shoji Fujikawa, Koga; Hideaki Haraguchi, Hikone, all of Japan

[73] Assignee: Matsushita Electric Works, Ltd., Osaka, Japan

[21] Appl. No.: 889,231

[22] Filed: May 27, 1992

[30] Foreign Application Priority Data

May 28, 1991 [JP] Japan ..... 3-121631

[51] Int. Cl.[5] ..... B26B 19/00; B26B 19/06; B26B 19/20

[52] U.S. Cl. ..... 30/131; 30/196; 30/200

[58] Field of Search ..... 30/131, 179, 195, 196, 30/198, 200, 201

[56] References Cited

U.S. PATENT DOCUMENTS

| | | | |
|---|---|---|---|
| 4,825,546 | 5/1989 | Araki et al. | 30/196 |
| 4,949,460 | 8/1990 | Sterk | 30/200 |
| 5,050,304 | 9/1991 | Fujikawa et al. | 30/200 |
| 5,084,974 | 2/1992 | Sukow et al. | 30/196 |
| 5,123,159 | 6/1992 | Kubo et al. | 30/196 |

*Primary Examiner*—Douglas D. Watts
*Assistant Examiner*—Paul M. Heyrana, Sr.
*Attorney, Agent, or Firm*—Stevens, Davis, Miller & Mosher

[57] ABSTRACT

A hair clipper includes, in addition to a cutter head, a hair entrapping member and a hair pressing member which are both movable relative to a cutting edge of the cutter head. The cutter head comprises a toothed stationary blade and a toothed movable blade. The movable blade is driven to reciprocate in shearing engagement with the stationary blade for shearing hairs therebetween. The hair entrapping member is movable between an open position and a closed position. In the open position the hair entrapping member is spaced away from the cutting edge of the cutter head, thus permitting hairs to enter between the hair entrapping member and the cutting edge. In the closed position, the hair entrapping member is held close to the cutting edge to thereby seize the hairs therebetween for shearing the hairs. The hair pressing member is also made movable relative to the hair entrapping member between a pressing position of holding the hairs against the hair entrapping member forwardly of the cutting edge and a release position of being spaced away therefrom. The hair pressing member is interlocked with the hair entrapping member such that the hair pressing member comes into the pressing position before the cutting edge comes into the closed position, whereby the hairs can be pressed against the hair pressing member prior to being sheared by the cutting edge.

13 Claims, 24 Drawing Sheets

140
146
144
150
148
160
33
31
162
161
162
11
10
62
40
44
42
41
47
60
46
45
37
37
92
64
90
67
52
68
66
23
54
63
61
65
64
53
22
20
18
51
12
103
101
29
102
100
75
82
81
25
82
77
70

HAIR CLIPPER

BACKGROUND OF THE INVENTION

1. Field of the Invention

The present invention is directed to a hair clipper, and more particularly to a home use hair clipper having a cutter head and a hair entrapping member which is movable toward and away from a cutting edge of the cutter head.

2. Description of the Prior Art

Home hair shearing has been generally done by the use of scissors With the scissors, it is rather difficult for an unskilled person to perform hair shearing since it requires to manipulate the scissors in one hand and at the same time to hold hairs between the fingers of the other hand. Particularly, when manipulating the scissors, the blade edges of the scissors will engage the hairs at an inclined angle and be likely to push the hairs out of position along the blade edges as the blades are closed, failing to provide a straight cut. Thus, the straight cut with the use of the scissors requires a considerable skill and is found not to be practical at home. On the other hand, powered hair clippers have been utilized for many years in homes which are easy to manipulate and effect a straight cut. The prior hair clipper, as typically shown in U.S. Pat. No. 4,825,546, is provided with a cutting head having a toothed stationary blade and a toothed movable blade. The movable blade is driven to reciprocate in hair shearing engagement between the toothed edges of the stationary and movable blades. Although the prior hair clipper may have a comb projecting past the cutting edge of the cutter head, it is manipulated to move in advance of the cutting edge which are held in contact or in close relation with the skin. Therefore, the prior art hair clipper is still required to be carefully manipulated in such a manner not to injure the skin by the cutting edge. This is particularly important when shearing the hairs of a baby or child. To eliminate the above problems and insufficiencies, a unique hair clippers have been proposed in U.S. Pat. No. 5,050,304 and also in application Ser. No. 565,501 filed on Aug. 10, 1990, now U.S. Pat. No. 5,123,151, in which an elongated base cover is hinged to a like elongated housing formed at its front end with a cutting head with a cutting edge. The base cover is formed with a hair entrapping member which moves toward and away from the cutting edge for entrapping the hairs between the cutting edge and the hair entrapping member for immediate shearing thereat. Even with these proposed hair clippers, however, there remains a problem that the hairs are likely to shift or escape when manipulating to close the hair entrapping member against the cutting edge for hair shearing therebetween. This makes it rather difficult and inconvenient to shear the hairs in a desired fashion. In this respect, the prior art hair clippers are found still insatisfatory for achieving a convenient hair styling even by a unskilled user.

SUMMARY OF THE INVENTION

The above problem has been eliminated by the present invention which provides an improved hair clipper which can be easily manipulated by an unskilled person and is particularly suitable for home use. The hair clipper in accordance with the present invention comprises a cutter head and a hair entrapping member which is adapted to be in slidable contact with the skin of a head. The cutter head includes a stationary blade with a toothed edge which defines a cutting edge of the cutter head and a movable blade with a like toothed edge. The movable blade is driven to reciprocate in hair shearing engagement between the toothed edges of the stationary and movable blades for shearing hairs therebetween. The hair entrapping member is made movable between an open position and a closed position. In the open position the hair entrapping member is spaced away from the cutting edge to allow hairs to enter between the member and the cutting edge. In the closed position, the comb is held close to the cutting edge so as to seize the hairs therebetween for shearing the hairs. Thus, the hair shearing can be made by guiding the hair entrapping member across the skin of the head to collect the hairs between the member and the cutting edge and subsequently to shear thus collected hairs by the cutting edge. In this manner, the hair shearing can be made by repeating to move the hair entrapping member from the open position to the closed position while guiding only the hair entrapping member in direct or close contact with the skin and maintaining the cutting edge spaced away from the skin, eliminating the possibility of injuring the skin by the cutting edge during the hair shearing operation. Also included in the hair clipper is a hair pressing member which is interlocked with the cutter head and the hair entrapping member to be also movable between a pressing position of holding the hairs against the hair entrapping member forwardly of the cutting edge and a release position of being spaced away therefrom. The hair pressing member is arranged to be brought into the pressing position against the hair entrapping member before the cutting edge is closed against the hair entrapping member. Whereby, the hairs can be pressed against the hair pressing member prior to being sheared by the cutting edge so that the hair can be prevented from escaping or being put aside until the hairs are sheared.

Accordingly, it is a primary object of the present invention to provide an improved hair clipper which is capable of firmly holding the hairs in place before the hair shearing for effecting a desired hair shearing or styling conveniently and easily.

In a preferred embodiment, the hair pressing member is made of a transparent material through which the engagement of the hairs between said cutting edge and said hair entrapping member can be viewed. With this arrangement, the user can be easily confirmed of the cutting length or the amount of the hair intended to be sheared and be readily assured of a desired hair styling, which is therefore another object of the present invention.

The cutter head, hair entrapping member, and hair pressing member are formed at forward ends respectively of a housing, a base, and a cover which are all elongated members and pivotally connected to each other at the rear ends thereof such that the housing and the cover are movable relative to the base respectively between the closed and open positions and between the pressing and release positions. The housing is urged toward the open position by means of a first spring interposed between the housing and the base. The cover is overlapped on the housing and urged toward the release position by means of a second spring interposed between the cover and the housing in combination of the first spring. Thus, the cover and the housing are pivotally connected relative to the base and urged away therefrom in order to form a chipper assembly resembling a conventional stapler. That is, the housing and the cover can be manipulated to close and open relative to the base in the like manner as manipulating the stapler. Thus, the hair cutting can be performed by closing the housing and the hair pressing member to the base against the spring bias in much the same way as the stapler. The first spring is selected to exert a strong spring bias than the second spring, which facilities to firstly move the hair pressing member into the pressing position before moving the cutting edge into the closed position relative to the hair entrapping member, which is therefore a further object of the present invention.

The second spring is secured at its one end to the cover with the other end thereof in abuttable relation to the housing such that the cover is movable relative to the housing by a limited distance. The second spring carries a push bottom which projects through a window formed in the cover to be accessible by the user such that upon pressing the push button, the cover is firstly caused to move relative to the aid base independently of the housing against the bias of the second spring for bringing the hair pressing member into the pressing position, after which the housing is caused to move toward the base against the bias of the first spring for bringing the hair entrapping member into the closed position.

The cover is shaped to have such a portion adjacent the hair pressing member as to surround the cutting edge for preventing the clipped hairs from scattering outwardly, which is therefore a still further object of the present invention.

The hair entrapping member is preferably shaped to have at its leading edge comb teeth arranged in parallel with the cutting edge for smoothing the hairs into between the comb and the cutting edge. Preferably, the hair pressing member is formed to have like comb teeth in meshing engagement with the comb teeth on the hair entrapping member for securely holding the hairs therebetween while effecting the smoothening the hairs also by the comb teeth on the hair pressing member on the side of the housing, which is therefore a still further object of the present invention.

In the present invention, the comb teeth of different designs are disclosed to effectively hold the hairs in place over the length of the hair entrapping member in order to further facilitate the hair shearing.

These and still other objects and advantages of the present invention will become more apparent from the following detailed description of the preferred embodiments when taken in conjunction with the accompanying drawings.

DETAILED DESCRIPTION OF THE PREFERRED EMBODIMENTS

First Embodiment <FIGS. 1 to 16>

Figure 1:
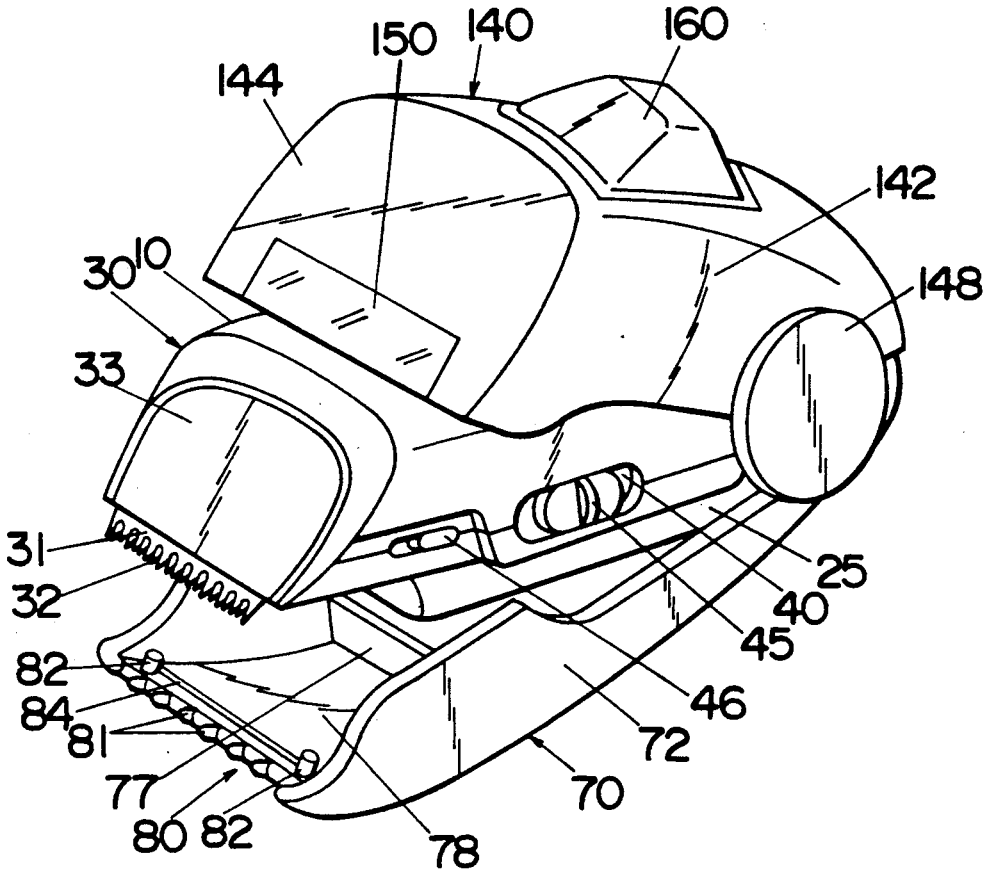
FIGS. 1 and 2 are perspective views of a hair clipper shown respectively in open and closed positions in accordance with a first embodiment of the present invention.
Figure 2:
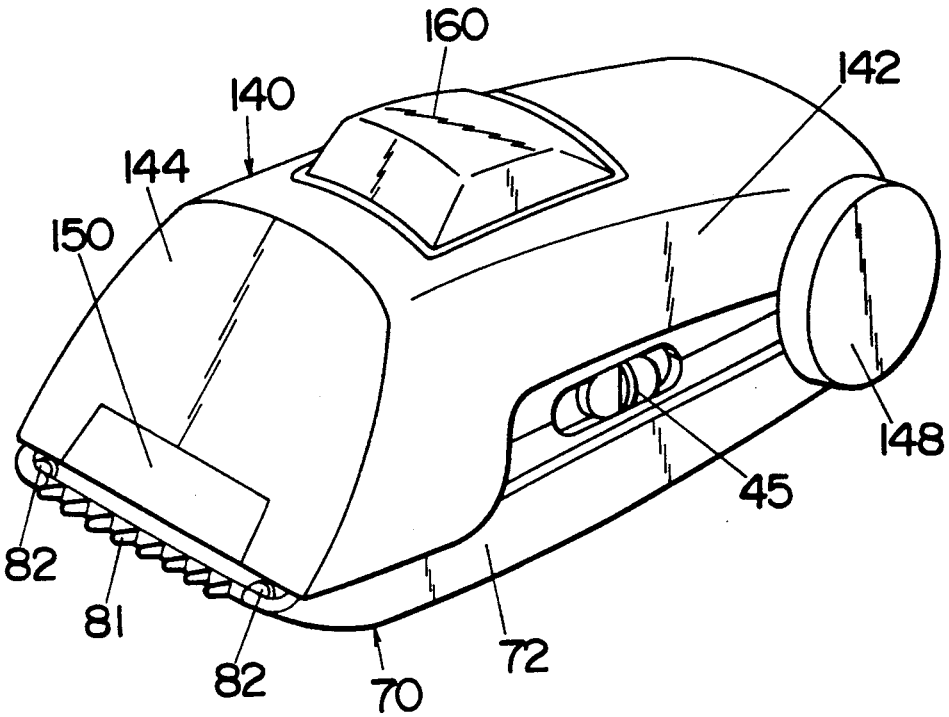

Referring now to FIGS. 1 and 2, there is shown a handheld clipper in accordance with a first embodiment of the present invention. The hair clipper comprises an elongated housing 10 and an elongated base 70 which are pivotally connected at their rear ends to be movable between an open position of FIG. 1 and a closed position of FIG. 2, in a like manner as a conventional stapler. As seen in the figures, the housing 10 has its longitudinal axis crossed with a longitudinal axis of the base 70 at an angle of about 15° in the open position and has the former axis generally in parallel relation with the latter axis in the closed position. Also included in the hair clipper is an elongated cover 140 which is fitted over the housing 10 and is pivotally connected at its rear end to the base 70 to be movable relative thereto between a release position of FIG. 3 and a pressing position of FIG. 4. In the release position, a hair pressing member 150 formed at the front end of the cover 140 is kept away from the front edge of the base 70. In the pressing position, the hair pressing member 150 is held close to the front edge of the base 70 to press the hairs therebetween, the detail of which will be discussed in later.

Figure 7:
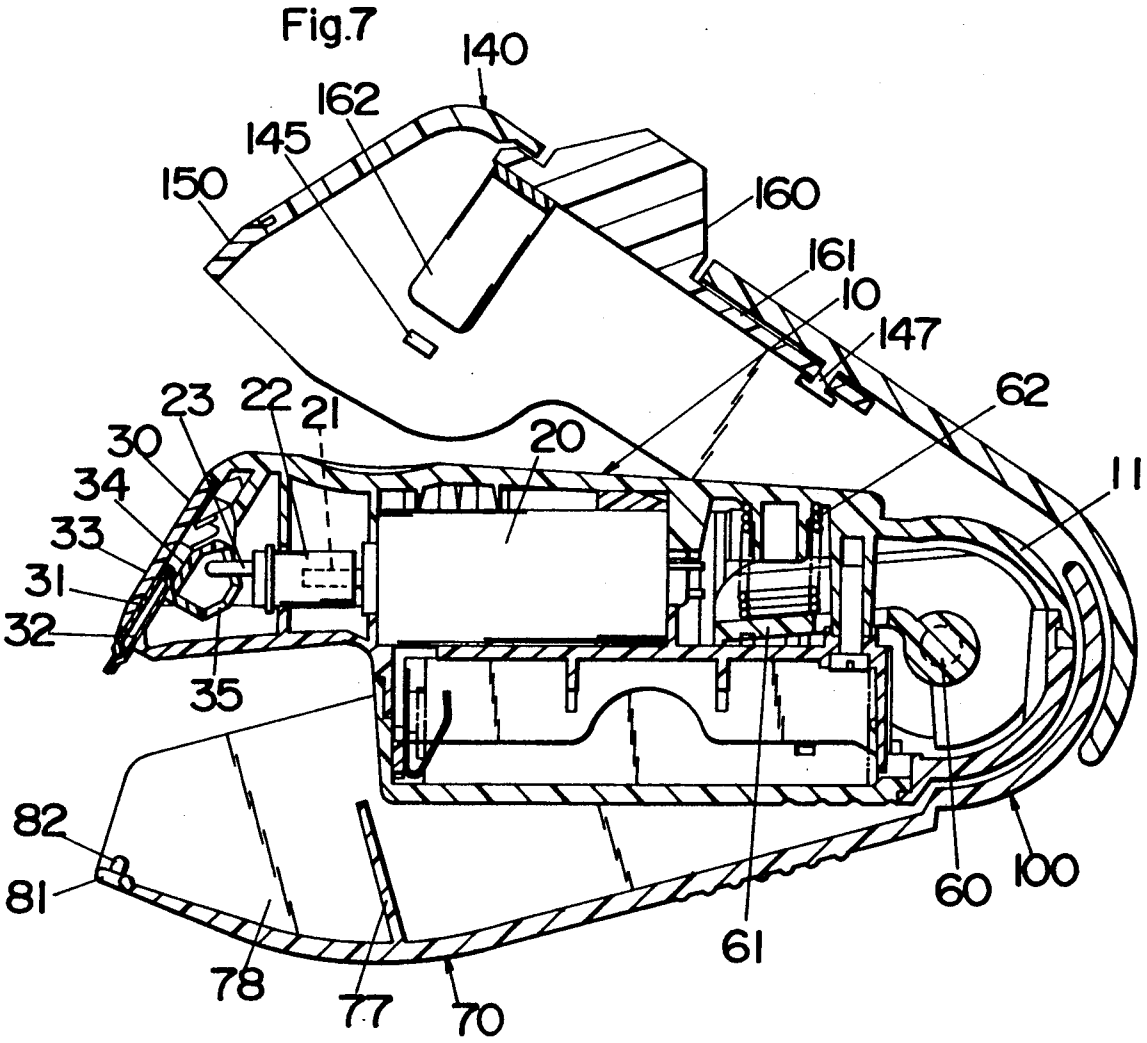
FIG. 7 is a sectional view of the hair clipper with a housing and the cover are shown in their open and release positions.
Figure 8:
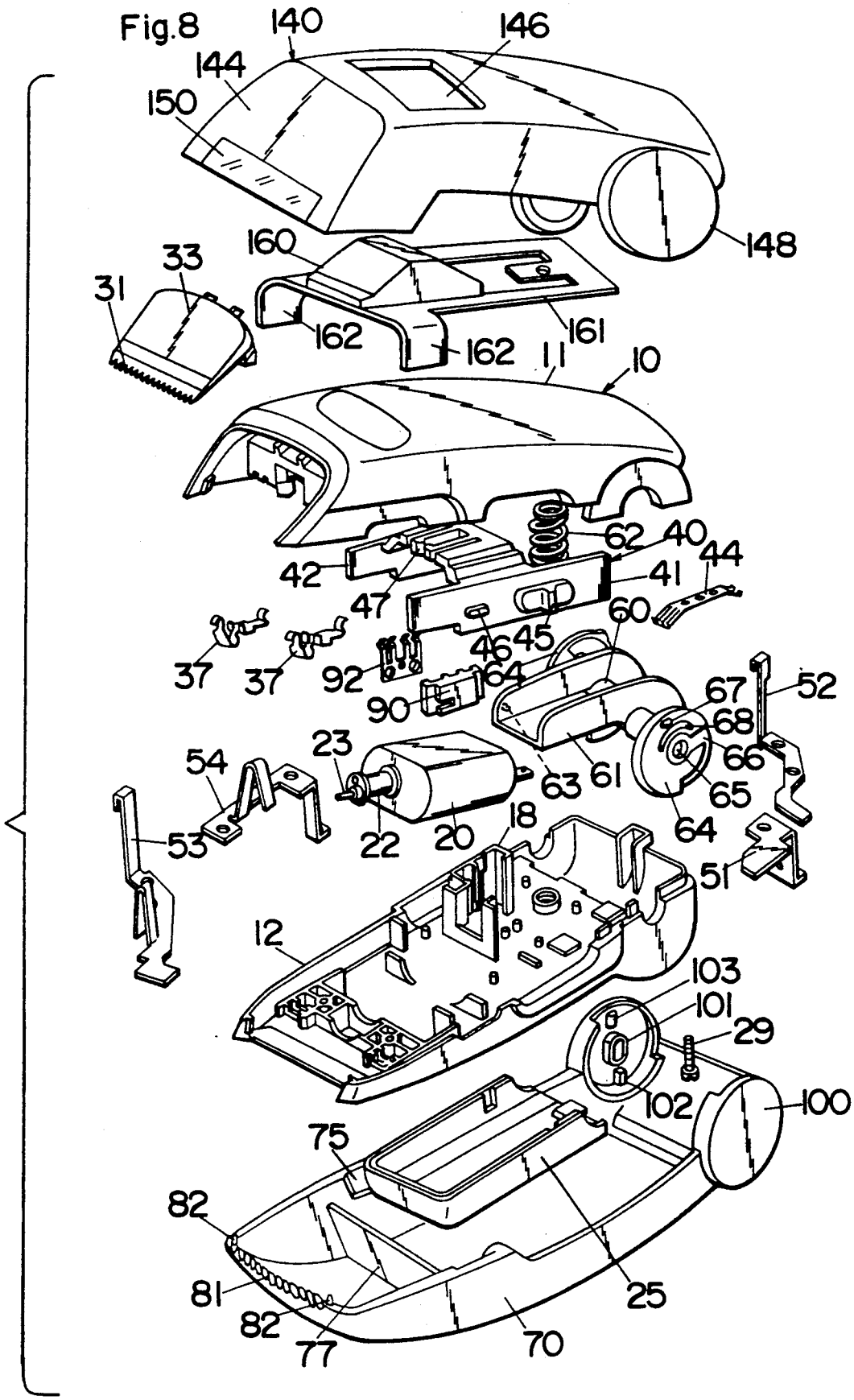
FIG. 8 is an exploded perspective view of the hair clipper.
Figure 9:
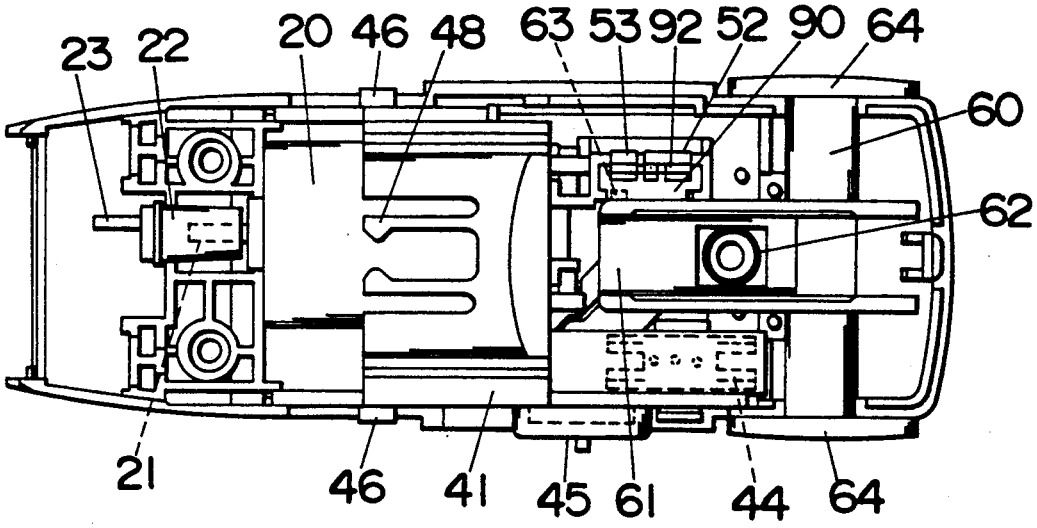
FIG. 9 is a plan view of the hair clipper with a top portion of the housing and the base removed.

The housing 10 is provided at its front end with a cutter head 30 which comprises a stationary blade 31 with a toothed edge and a movable blade 32 with a like toothed edge. As shown in FIG. 7, the stationary blade 31 is supported on an interior surface of a head plate 33 fitted in the front end of the housing 10 The movable blade 32 is supported at its one end by a carrier 34 which is held slidable on the interior surface of the head plate 33 such that the toothed edge of the movable blade 32 is in hair shearing engagement with the corresponding toothed edge of the stationary blade 31 with the leading edge of the movable blade 31 offset upwardly or retarded from the forwardly adjacent leading edge of the stationary cutter by a slight extent. The stationary blade 31 and the movable blade 32 define therebetween a cutting plane which is inclined by an angle 50° to 90° with respect to a longitudinal axis of the housing 10. The cutter head 30 thus formed is held in position by a pair of clips 37 each of which, as shown in FIG. 8, have its ends hooked to the head plate 33 and the interior of the housing 10.

Disposed in the middle of the housing 10 is an electric motor 20 Which has an output shaft 21 coupled to a joint 22 With an eccentric shaft 23. The eccentric shaft 23 engages into a cam socket 35 formed on the carrier 34 in order to translate the rotational movement of the output shaft 21 into a reciprocating movement of the movable blade 32 relative to the stationary blade 31. A battery casing 25 is formed below the motor 20 to extend longitudinally over the middle and rear portions of the housing 10 for receiving therein a couple of dry batteries (not shown) energizing the motor 20. The battery casing 25 is fitted with a detachable lid 27 which is slidable along the casing 25 to close the same.

As best shown in FIG. B, the housing 10 comprises upper and lower halves 11 and 12 between which a slider 40 is received together with the motor 20. The slider 40 has a pair of opposed side bars 41 and 42 connected by a center plate 43 which is slidably held between the motor 20 and the inner surface of the upper housing 11. One of the side bar 41 is provided at its rear end with a contactor 44 which is cooperative with contact leads 51 to 53 to form a main power switch $SW_1$ for connecting and disconnecting the motor 20 to and from the batteries. Also formed on the same side bar 41 is a switch handle 45 which projects on the side face of the housing 10. The center plate 43 includes a pair of resilient arms 47 each having a latch projection 48 at its free end. The latch projections 48 are engageable with a catch (not seen) on the interior of the upper half 11 of the housing 10 in such a manner that the slider 40 is movable clickwise between three switching positions, i.e., OFF position, a dependent ON position, and an independent ON position, the detail of which will be discussed later.

Figure 4:
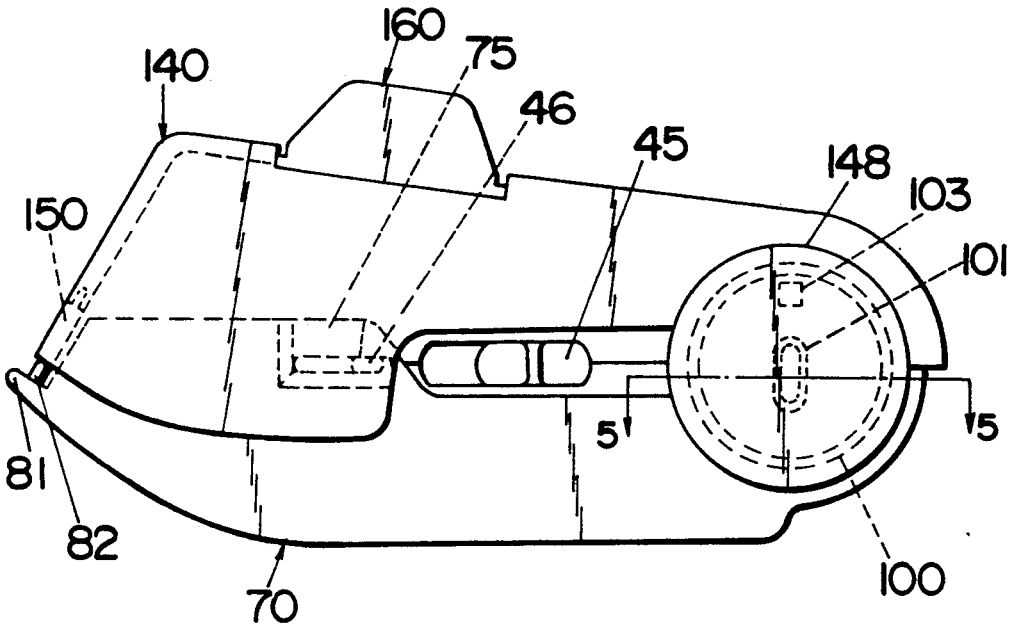
Figure 5:
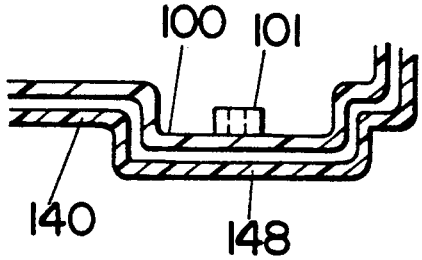
FIG. 5 is a sectional view taken along line 5—5 of FIG. 4.

The base 70 is of a generally U-shaped configuration having a bottom wall 71 and a pair of opposed side walls 72 extending upwardly from the lateral sides of the bottom wall 71 to define therebetween a space for receiving the bottom portion of the housing 10 in the closed position of FIGS. 2 and 4. Formed at the forward edge of the bottom wall 71 is a comb 80 with a number of comb teeth 81 arranged along the cutting edge for smoothing hairs prior to shearing the hairs by the cutter head 30. Disposed on the opposite ends of the array of the comb teeth 81 are a pair of studs 82 which are spaced rearwardly by a slight distance from the forward edge of the bottom wall 71 for abutment with the forward end of the cover 140, as shown in FIGS. 2 and 4, when the cover 140 is closed to its pressing position. The bottom wall of the base 70 is also formed at a portion rearwardly of the comb teeth 81 with a recess 84 having a continuous straight edge at its bottom against which the cutting edge of the cutter head 30 projects when the housing lo is pivoted into the closed position, as shown in FIG. 4.

Figure 10:
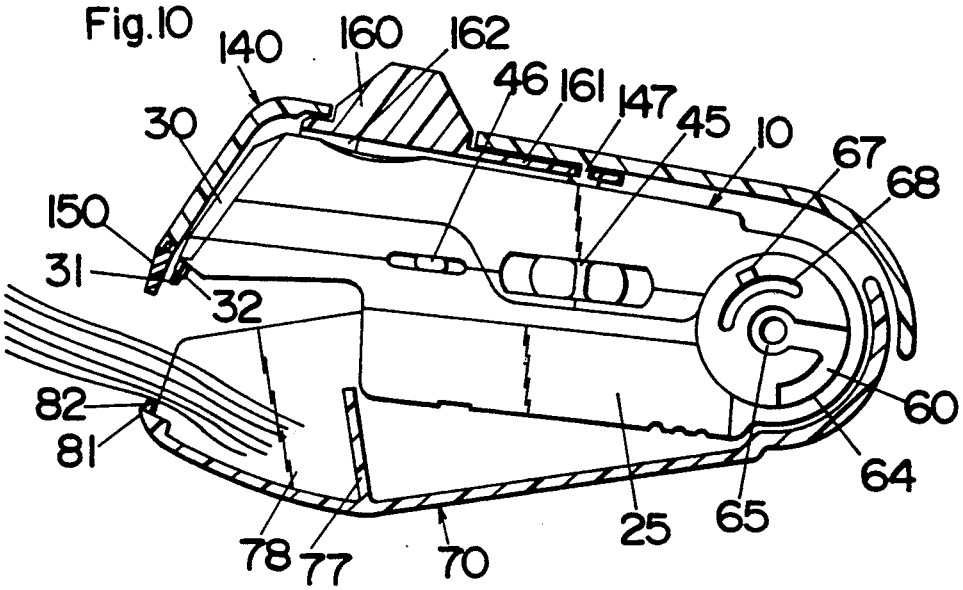
FIGS. 10 to 12 are explanatory views illustrating the hair cutting operation of the hair clipper.
Figure 11:
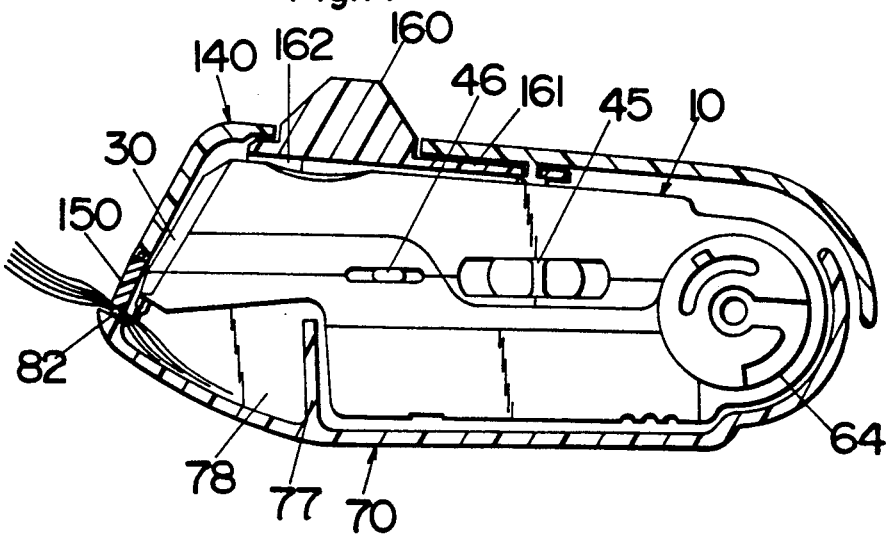
Figure 12:
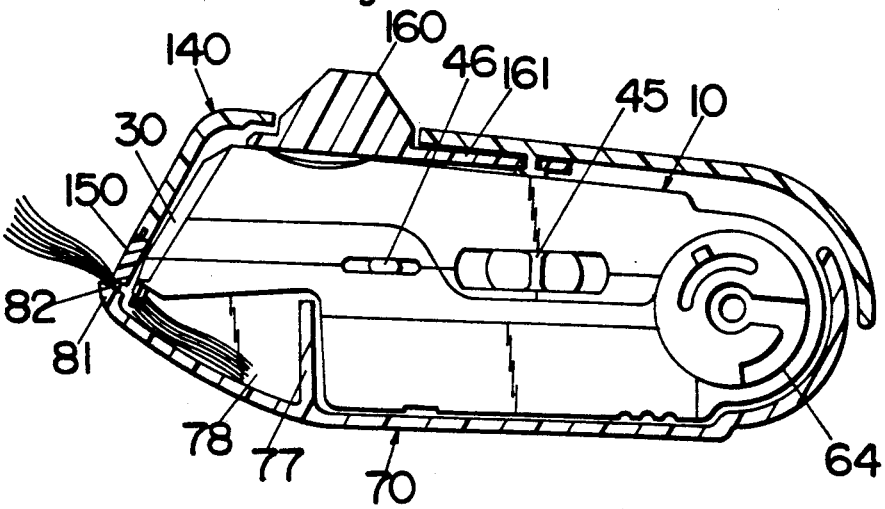
Figure 13:
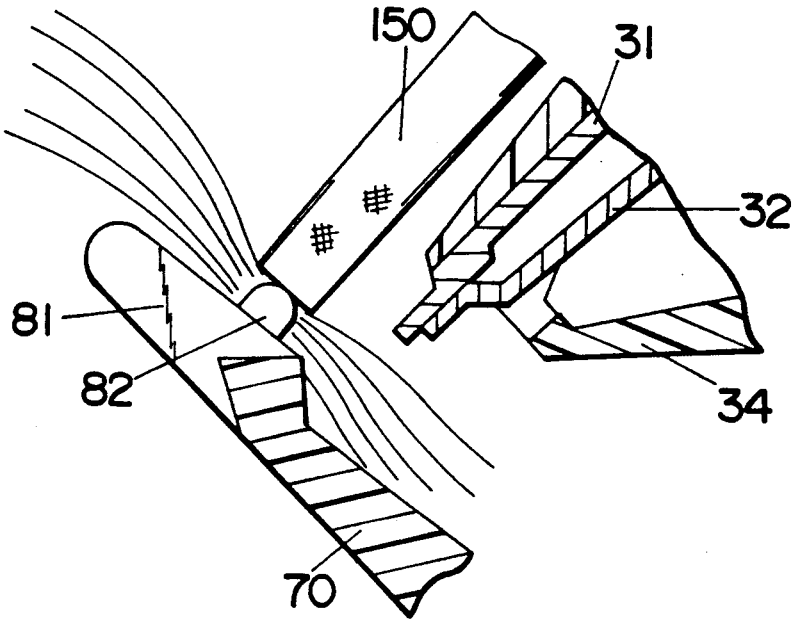
FIGS. 13 and 14 are enlarged view illustrating the relation between a cutting edge, a hair pressing member of the cover, and a hair entrapping member of the base.
Figure 14:
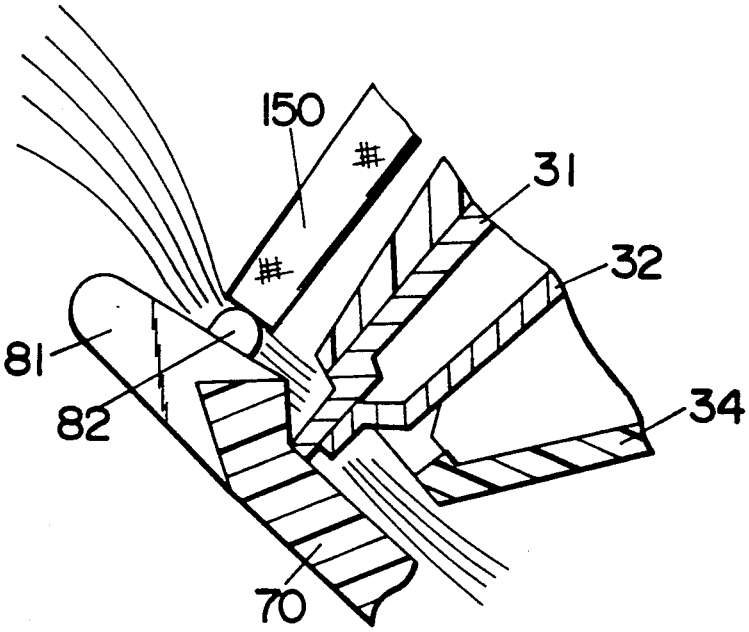

The cover 140 is shaped to have a generally U-shaped cross section having a top wall 141 and a pair of opposed side walls 142 extending downwardly from the lateral sides of the top wall 141 to define therebetween a space for receiving the upper portion of the housing 10. The cover 140 is formed to have a somewhat enlarged front hood fitted over the entire portion of the cutter head 30. The front hood includes an inclined front face 144 with a transparent member which defines the hair pressing member 150. The transparent member 150 extends along the lower end of the face 142 over a substantial width thereof in such a manner as to form a straight leading or lower edge at the front end of the cover 140 in cooperation with the adjacent lower end of the front face 144. When the Cover 140 is closed into the pressing position, the leading edge comes close to the comb teeth 81 with the opposite ends of the leading edge is kept in abutment against the studs 82 on the front end of the base 70, as shown in FIGS. 2 and 4. It is this position that the hairs after being smoothed by the comb teeth 81 are pressed between the hair pressing member 150 and the front end of the base 70, which serves as the hair entrapping member, to be ready for being cut by the cutting edge of the cutter head 30, as shown in FIGS. 11 and 13. As discussed later, the cover 140 is interlocked with the housing 10 such that the cover 140 comes into the pressing position of FIGS. 11 and 13 before the housing 10 comes into the closed position of FIGS. 12 and 14 in which the hairs are also held between the cutting edge of the cutter head 30 and the continuous straight edge just rearwardly of the comb teeth 81 and are simultaneously sheared by the cutting edge. That is, as shown in FIGS. 10 to 12, the hand clipper is firstly manipulated with the housing 10 and the cover 140 respectively in the open and release positions so as to smooth and guide the hairs between the comb teeth 81 and the cutter head 30 [FIG. 10]. Then the cover 140 is closed to the pressing position with the accompanied pivotal movement of the housing 10 to a position just before the closed position to hold the hairs between the front edges of the cover 140 and the base 70 [FIG. 11]. Subsequently, the housing 10 is finally pivoted to the closed position in order to have the cutting edge cut the held hairs against the bottom edge of the recess 84 rearwardly of the comb teeth 81 [FIG. 12]. In this manner, the hairs can be easily cut straight without exposing the cutting edge in the vicinity of the skin and with the hairs being firmly gripped between the cover 140 and the base 70, thereby assuring a safe and exact hair shearing without the fear of accidentally injuring the skin by the cutting head and into a desired hair styling. In this connection, it is noted that the recess 84 has a depth which, as best shown in FIG. 14, is greater than a gap distance between the leading edges of the stationary and movable blades 31 and 32 for facilitating to hold the hairs also between the cutting edge and the bottom of the recess 84 and therefore to cut the hairs without substantially missing the hairs, contributing to assure an even cut. It should also be noted here that the transparent member 150 allows the user to confirm the gripping of the hairs to be cut the cutter head 30.

The hair clipper can be manipulated by only one hand of a user and the hair shearing can be effected by repeatedly moving the cover 140 and the housing 10 toward the base 70 by means of a push button 160 projecting through a window 146 (FIG. 8) in the top wall 141 of the cover 140 to be accessible by the thumb of the user's hand gripping the hair clipper. The push button 160 is formed integrally on the front end of an elongated spring plate 161 which is secured at the rear end to the top wall 141 at 147 and includes a yoke 162 depending from the front end thereof. The spring plate 161 has a relatively strong spring characteristic such that, when pressing the button 160 with the cover 140 in the release position, the spring plate 161 moves together with the cover 140 until the spring plate 161 abuts against the housing 10 at the yoke 162, after which the spring plate 161 is allowed to flex independently of the cover 140 to press the housing 10 toward the closed position. As shown in FIG. 7, a pair of stops 145 are formed on the inner side walls 142 to restrict the downward movement of the spring plate 161 or the button 160 in order to prevent an over-pressing of the housing 10.

The pivotal connection between the housing 10 and the base 70 is effected by a pivot axle 60 bridging between the rear ends of the base 70 and journaled in a bearing hole 16 formed in the rear end of the housing 10 between the upper and lower halves 11 and 12. Integrally projecting from the middle of the axle 60 is a lever 61 which extends over a flat bottom portion at the rear end of the lower half 12. A compression coil spring 62 is interposed between the end of the lever 61 and the upper bottom of the upper half 11, as shown in FIG. 7, so as to bias the lever 61 in the counterclockwise direction in the figure and in turn bias the base 70 in that direction about the axle 60 relative to the housing 10, whereby biasing the housing 10 into the open position of FIG. 7. As seen in the figure, the coil spring 62 is fitted around a post 17 which projects integrally from the inner bottom of the upper half 11 and is utilized to receive a screw 29 fastening the upper and lower halves 11 and 12. The lever 61 is operatively connected at its free end to a slide member 90 with a stud 63 at the free end of the lever 61 engaged in a slit 91 of the slide member 90. The slide member 90 is held vertically movable within an upstanding frame 18 on the inner bottom of the lower half 12 and includes a contactor 92 which is cooperative with the contact leads 52 and 53 to form an auxiliary power switch $SW_2$. That is, the contactor 92 straddles over the upright segments of the contact leads 52 and 53 held in position within the frame 18 to make and break the conduction between the leads 52 and 53 in response to the vertical movement of the slide member 90 which is in turn responsive to the pivotal movement of the lever 61 or the base 70 relative to the housing 10. It is noted at this time that, as shown in the wiring diagram of FIG. 16, the above-mentioned main switch $SW_1$ comprises the contact leads 51, 52, and 53 and the contactor 44 which is movable together with the slider 40 between the three positions in constant contact only with the lead 51 connected to one electrode of the battery B. The other electrode of the battery B is connected by way of a lead element 54 to one end to the motor 20 of which other end is connected to the contact lead 53. The contact leads 52 and 53 have their respective ends arranged in spaced alignment with the end of the contact lead 51 such that the contactor 44 disconnects the leads 52 and 53 (the motor 20) from the lead 51 (the battery B) in the OFF position, straddles between the leads 51 and 52 in the dependent ON position, and straddles between the leads 51 and 53 to connect the motor 20 to the battery B in the independent ON position. In the dependent ON position of the main switch $SW_1$, the auxiliary switch $SW_2$ is operative to energize and deenergize the motor 20 in response to the movement of the housing 10 between the open and closed positions. That is, when the housing 10 is in the open position, the contactor 92 of the slide contact 90 is held by the lever 61 in an upper position of disconnecting the leads 52 and 53 from one another to deenergize the motor 20, but when the housing 10 is moved into the closed position, the contactor 92 is brought by the correspondingly pivoting lever 61 into a lower position of conducting the leads 52 and 53 for energizing the motor 20, or reciprocating the movable blade 32. In this manner, the auxiliary switch $SW_2$ is rendered active to effect the switching in response to the movement of the clipper between the open and closed positions while the main switch $SW_1$ is in the dependent position. In this switching mode, therefore, the hair clipper can effect the hair cutting each time the housing 10 is pressed into the closed position of FIG. 12, and can stop driving the movable blade 32 each time the housing 10 returns into the open position under the urgence of the coil spring 62 as the user removes the pressing force to the push button 160. On the other hand, when the main switch $SW_1$ is in the independent ON position, the auxiliary switch $SW_2$ is bypassed to thereby energize the motor 20 irrespective of the positions of the hair clipper, or the pivotal movement of the housing 10 relative to the base 70.

Figure 3:
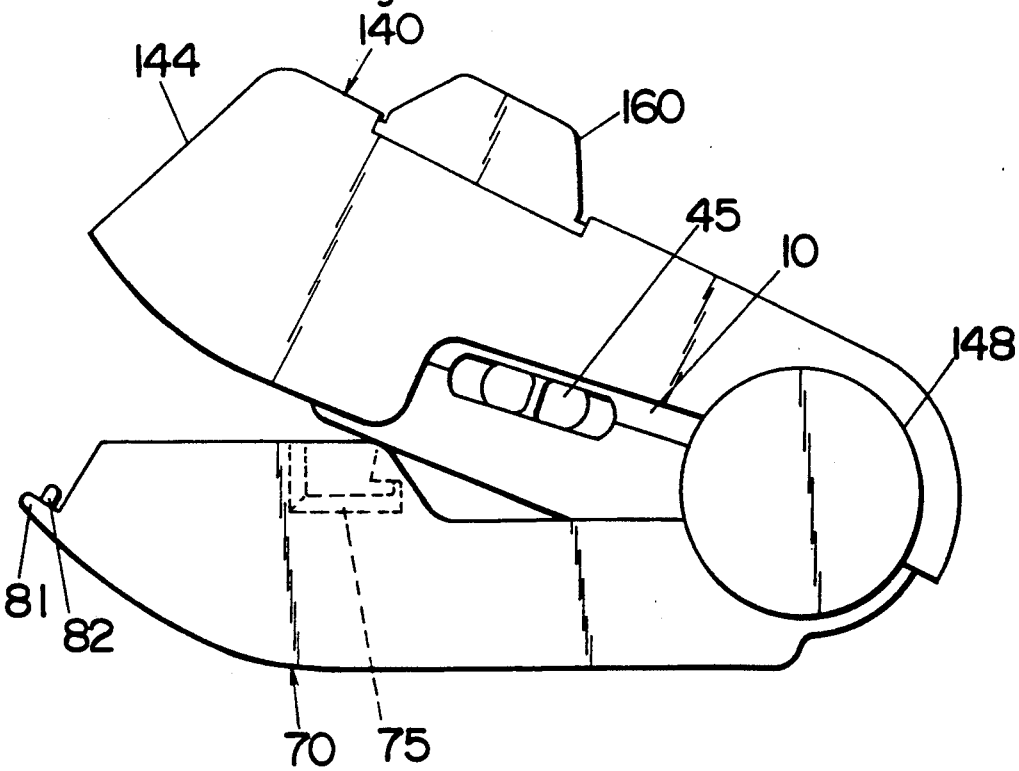
FIGS. 3 and 4 are sectional views of the hair clipper respectively in its open and closed positions.

At the OFF position of the main switch $SW_1$, the housing 10 can be locked into the closed position by engagement of latches 46 projected on the side faces of the housing 10 and grooves 75 formed respectively in the inner surface of the side walls 72 of the base 70, as shown in FIGS. 3 and 4. The latches 46 are formed on the side bars 41 and 42 of the slider 40 to be movable in the lengthwise direction of housing 10 together with the switch handle 45. As shown in the figures, the groove 75 is of a generally L-shaped configuration with a vertical segment and a horizontal segment defining therebetween a shoulder with which the latch 46 is to be engaged. A vertical section of the groove 75 is open to the upper edge of the side wall 72 so that the latch 46 at the dependent as well as dependent positions of the main switch $SW_1$ can freely enter into the groove 75 through the vertical section without being interfered with the shoulder 76 and that only the latch 46 at the OFF position can be engaged with the shoulder 76. The side walls 72 of the base 70 have enough resiliency such that they are capable of flexing outwardly to permit the latches 46 even at the OFF position of the main switch $SW_1$ to ride over shoulder 76 into engagement therebehind. The latch 46 at the independent or dependent ON position can be of course guided along the horizontal section into engagement with the shoulder 76 by sliding the switch handle 45 rearward while maintaining the housing 10 in the closed position. In brief, the housing 10 can be locked into the closed position irrespective of the positions of the switch handle 45.

The base 70 is provided with a partition 77 which is located immediately forwardly of the battery casing 25 in the closed position of the clipper so as to define a dust chamber 78 forwardly of the partition 77 for collecting the clipper hairs and preventing the collected hairs from scattering around the battery casing 25. The battery casing 25 is received in a space 79 defined rearwardly of the partition 77 when the clipper is in the closed position.

Turning back to FIG. 8, the above pivot axle 60 is provided at its ends with rotor discs 64 which are supported within circular brackets 100 correspondingly formed at the rear end of the base 70 in such a manner that the axle 60 is also pivotable through a limited angular distance about an axis of the axle 60 with respect to the base 70, allowing the housing 10 to move past the open position further into an extended position in which the housing 10 is kept at an angle of about 120° with respect to the base 70. In brief, the housing 10 pivots between the above open and closed position about the axis of the axle 60 with the axle 60 being kept rotatively fixed to the base 70, and the housing 10 pivots between the open and extended positions with an attendant pivotal movement of the axle 60 or the rotor discs 64 relative to the base 70.

In detail, as seen in FIG. 8, each of the rotor discs 64 is provided in its center with a bearing hole 65 into which a ring projection 101 at the inner center of each bracket 100 extends for rotatively supporting the axle 60 between the brackets 100. Extending circumferentially around a portion of each disc 64 is a groove 66 within which a retainer pin 102 on the interior of each bracket 100 is allowed to move for pivoting the base 70 independently of the housing 10. A cam projection 103 is provided on the interior of each bracket 100 in a diametrically opposed relation to the pin 102 which engages with and clicks over a corresponding cam projection 67 formed on each disk 64 adjacent an arcuate slot 68. After the cam projection 103 clicks over the corresponding projection 67 with the retainer pin 102 abutting against one end of the groove 66, the base 70 is rotatably fixed to the disc 64 or the pivot axle 60 so that the base 70 is caused to move together with the pivot axle 60 relative to the housing between the open and closed positions. It is noted at this point that by engagement between the lever 61 and the housing 10, the axle 60 itself will pivot together with the housing 10 relative to the base 70 between the open position and the extended position, while the housing 10 will pivot about the axis of the axle 60 against and under the bias of the spring 62 between the open and closed positions. The brackets 100 of the base 70 are capable of flexing outwardly so as to be detachable from the corresponding discs 64 for separation of the base 70 from the housing 10.

The cover 140 is formed at its rear end with a pair of circular caps 148 which are fitted over the brackets 100 of the base 70 in a rotatable relation thereto such that the cover 140 is pivotally connected to the base 70. Thus, the cover 140 is pivotable about the axis of the axle 60 independently of the base 70 and the housing 10. It is noted in this connection that the spring 62 biasing the housing 10 into the open position is selected to have a weaker biasing force than the spring plate 161 such that the pressing of the button 160 will successfully cause the housing 10 to move into the closed position against the bias of the spring 62. It is noted in this connection that the spring plate 161 is cooperative with the spring 62 to exert a return bias to move the cover 140 from the pressing position of FIG. 12 back to the position of FIG. 10 upon release of the pressing force by the user. The user can be always be confirmed of the housing 10 having moved into the closed position by the pressing amount of the button 160. When the housing 10 is moved into the closed position, as shown in FIGS. 4 and 12, the front hood of the cover 140 overlaps the front portion of the base to entirely surround the cutter head 30 therebetween, thereby preventing the clipped hairs from escaping outwardly and successfully collecting them into the dust chamber 78.

Figure 6:
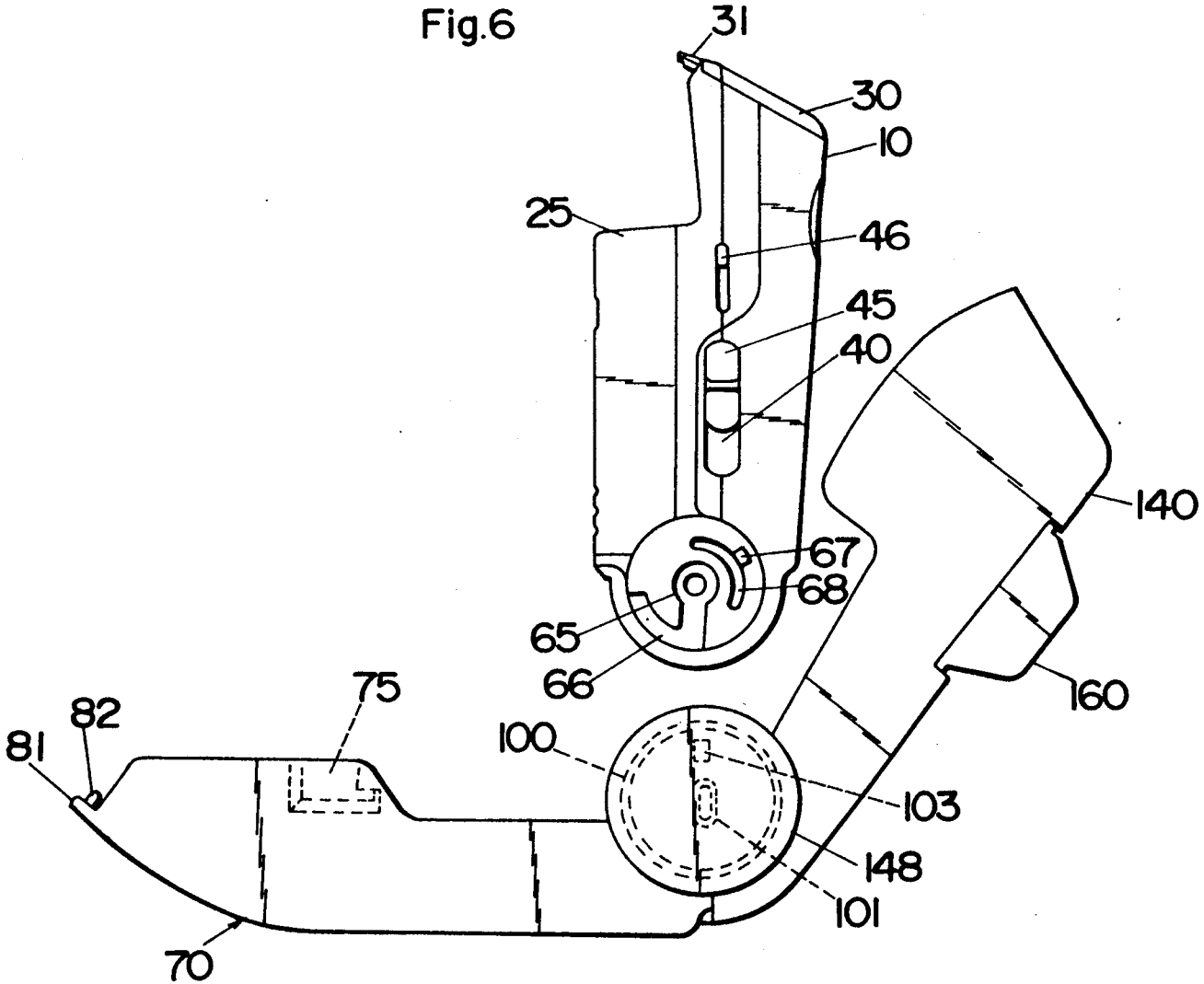
FIG. 6 is an exploded view of the hair clippers with a cover and a base thereof shown in a pivotally connected condition.
Figure 15:
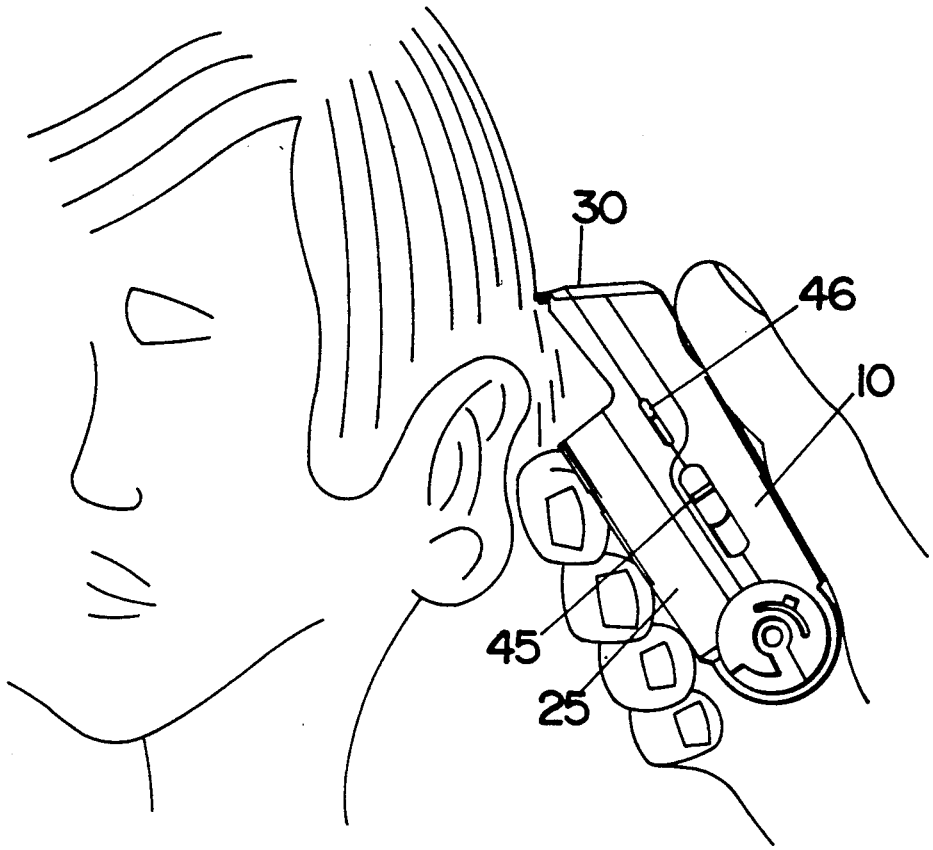
FIG. 15 is a view explaining the trimming operation of the hair clipper with the base and the cover detached.
Figure 16:
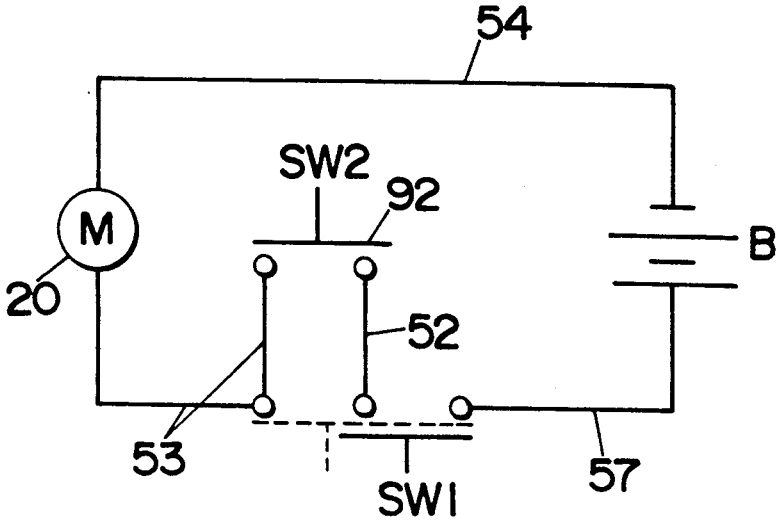
FIG. 16 is a wiring diagram of a power circuit of the hair clipper.
Figure 17:
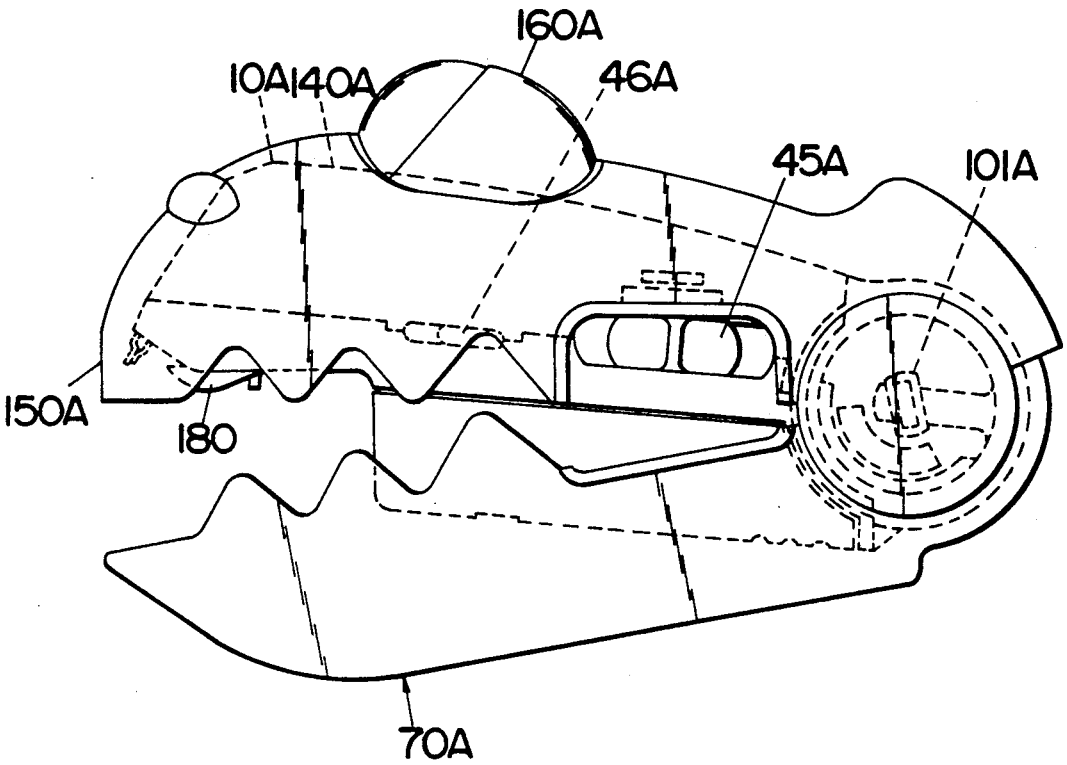
FIG. 17 is a front view of a hair clipper in accordance with a second embodiment of the present invention.
Figure 18:
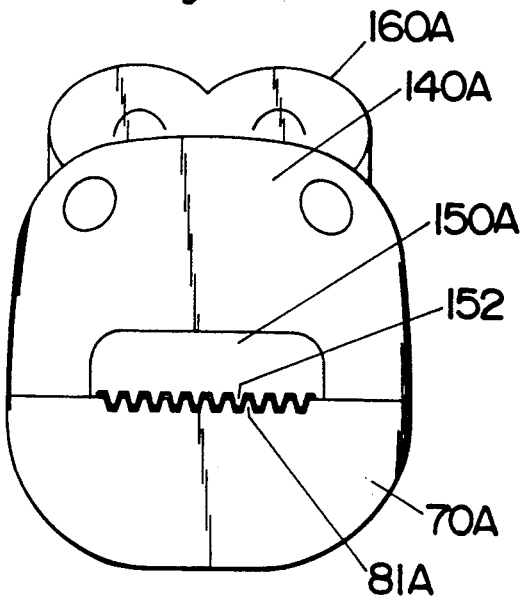
FIG. 18 is a side view of the hair clipper of FIG. 17.

The hair clipper thus assembled can be used for trimming the hairs, as shown in FIG. 15, simply by detaching the base 70 and the cover 140 together from the housing 10 as shown in FIG. 6.

Second Embodiment <FIGS. 17 to 47>

A hair clipper in accordance with a second embodiment of the present invention is shown to have a hair pressing member 150A which is formed to have comb teeth 152 for meshing engagement with comb teeth 81A on the front end of a base 70A. The basic structure of the hair clipper is identical to the first embodiment and therefore no further explanation thereof is deemed necessary. Like parts are designated by like numerals with the suffix letter of "A". The base 70A and the cover 140A are pivotally connected to a like housing 10A by a like mechanism such that the housing 10A is pivotable between an open position of FIG. 17 and a closed position of FIG. 19 and also that the cover 140A is pivotable between a release position of FIG. 17 and a pressing position of FIG. 19. The base 70A and the cover 140A are formed respectively at their side walls with sawteeth which are designed in analogy to an animal's jaw and engage with each other when the cover 140A is closed to the pressing position. The housing 10A is provided at its front end with a like cutter head 30A having a stationary blade 31A and a movable blade 32 which define therebetween a cutting plane inclined at an angle $\Theta$ of 50° to 90° with respect to a longitudinal axis of the housing 10A.

Figure 22:
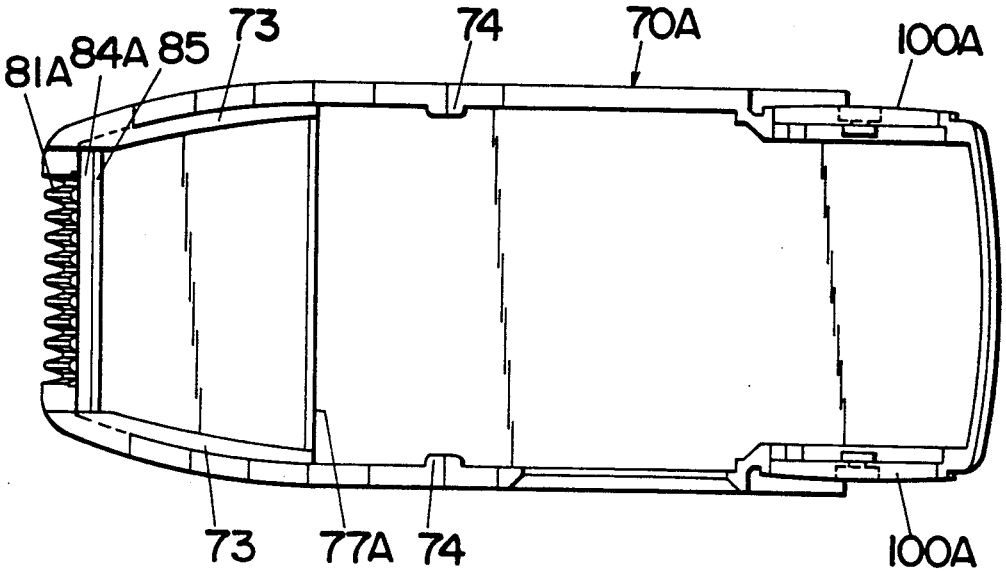
FIG. 22 is a top view of a base constituting the hair clipper.
Figure 23:
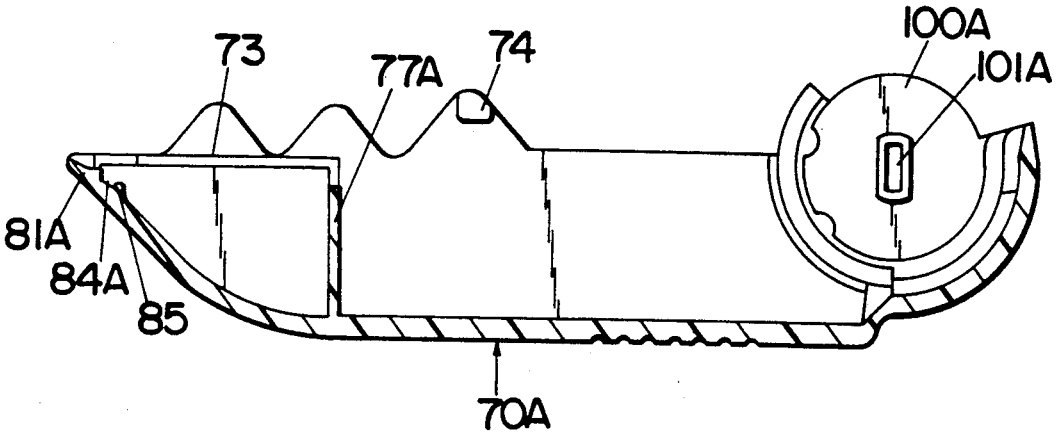
FIG. 23 is a sectional view of the base.

As shown in FIGS. 22 and 23, the base 70A is formed at its front edge with comb teeth 81A arranged in parallel with a cutting edge of the cutting head 30A. Formed immediately rearwardly of the comb teeth 81A is a recess 84A into which the cutting edge projects when the housing 10A pivots into the closed position for cutting the hairs between the cutting edge and a continuous straight edge at the bottom of the recess 84A. The recess 84A is defined forwardly of a ridge 85 extending in parallel with the comb teeth 81A. A pair of inward flanges 73 extends along the upper ends of the side walls 72 from points just rearwardly of the comb teeth to a partition 77A in order to prevent the clipped hair from escaping outwardly and retain them within a dust chamber 78A formed forwardly of the partition 77A. The base 70A is formed at its rear end with a pair of brackets 100A for pivotal connection to the housing 10A through a pivot axle 60A in the like manner as in the first embodiment. Lock projections 74 are formed on the upper end of the side walls 72 for locking engagement with latches 46A on a switch slider 40A.

Figure 24:
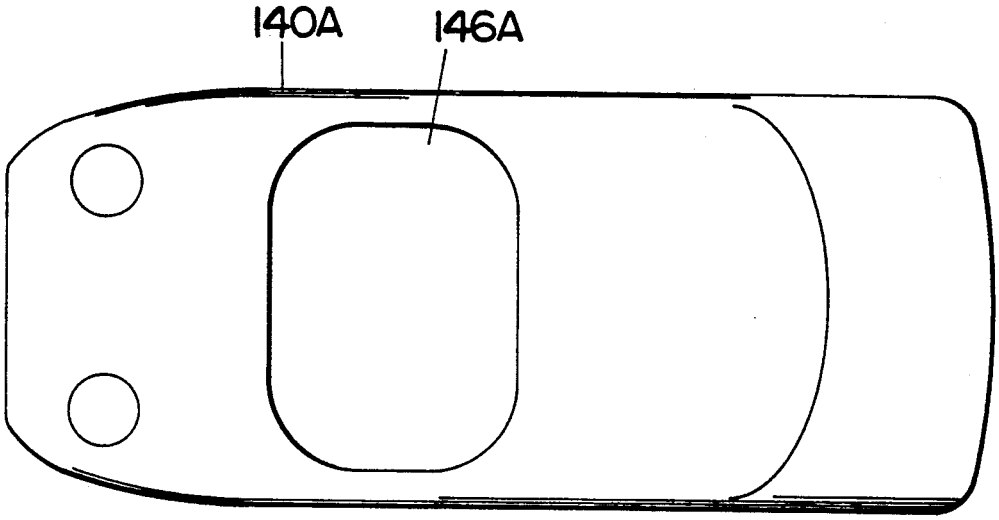
FIG. 24 is a top view of a cover constituting the hair clipper.
Figure 25:
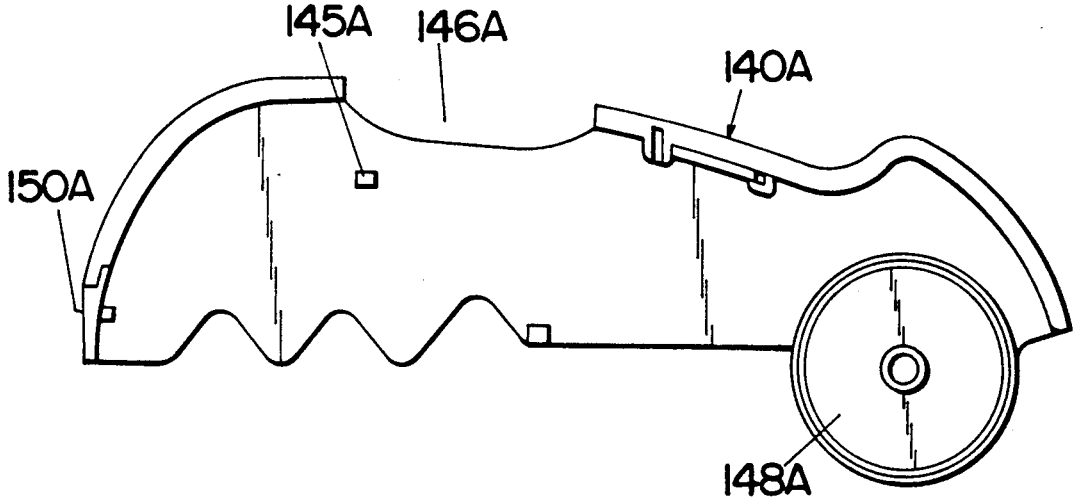
FIG. 25 is a sectional view of the cover.
Figure 26:
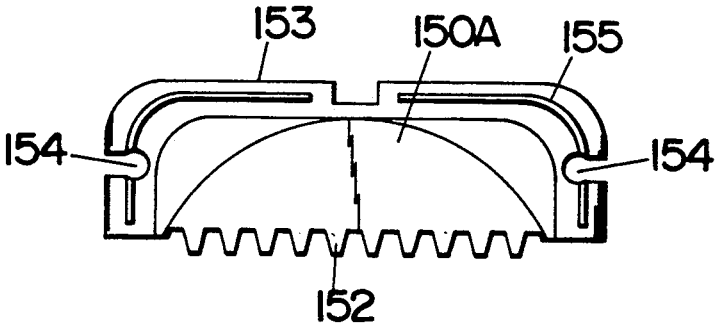
FIG. 26 is a front view of a hair pressing member provided at the front end of the cover.
Figure 27:
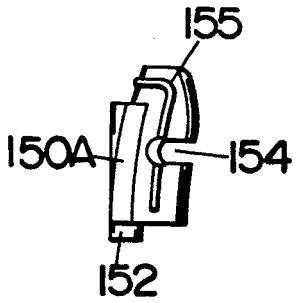
FIG. 27 is a view illustrating the connection of the hair pressing member to the cover.

As shown in FIGS. 24 and 25, the cover 140A is formed at its rear end with a pair of caps 148A for pivotable connection to the corresponding brackets 100A of the base 70A in the like manner as in the first embodiment. A window 146A is formed in the top wall of the cover to receive a like push button 160A for manipulating to move the cover 140A and the housing 10A toward the base 70A. Disposed at the front end of the cover 140A is the hair pressing member 150A in the form of a transparent plate with the comb teeth 152 along the lower edge thereof. As shown in FIGS. 26 and 27, the plate 150A is molded integrally to have a rim 153 which surrounds the upper and side edges of the plate 150 and is formed with notches 154 for engagement with corresponding members on the cover 140A and also with an integral ridge 155 at which the plate 150A is secured to the corresponding portion of the cover 140A by ultrasonic welding. When the cover 140A is closed to the pressing position, the comb teeth 152 of the plate 150A comes into meshing engagement with the comb teeth 81A of the base 70A in a somewhat loose manner as to leave therebetween a gap of 0.5 to 1.0 mm. With this engagement, the hair can be firmly gripped between the cover 140A and the base 70A prior to being sheared by the cutting edge. Hair cutting operation is made through the steps of FIGS. 32 to 34 in the like manner as in the first embodiment. After the hairs are introduced as being smoothened by the comb teeth 81A [FIG. 32], the cover 140A is closed to the pressing position by pressing the button 60A to hold the hairs between the comb teeth 81A and the 152 with the housing 10A kept in the open position [FIG. 33]. Thereafter, the housing 10A is moved to the closed position by further pressing the button 160A with the cover 140A kept in the pressing position, whereby shearing the hairs by the cutting edge [FIG. 34]. It should be noted at this time that when the hairs are held between the comb teeth 81A and the 152, the hairs are distributed over the top, side and bottom of the teeth so as to be displaced relative to the cutting edge in a direction perpendicular to the cutting edge. Thus held hairs can be therefore sheared rather successively and not simultaneously, resulting in an effective and smooth hair shearing by the cutting edge.

Figure 31:
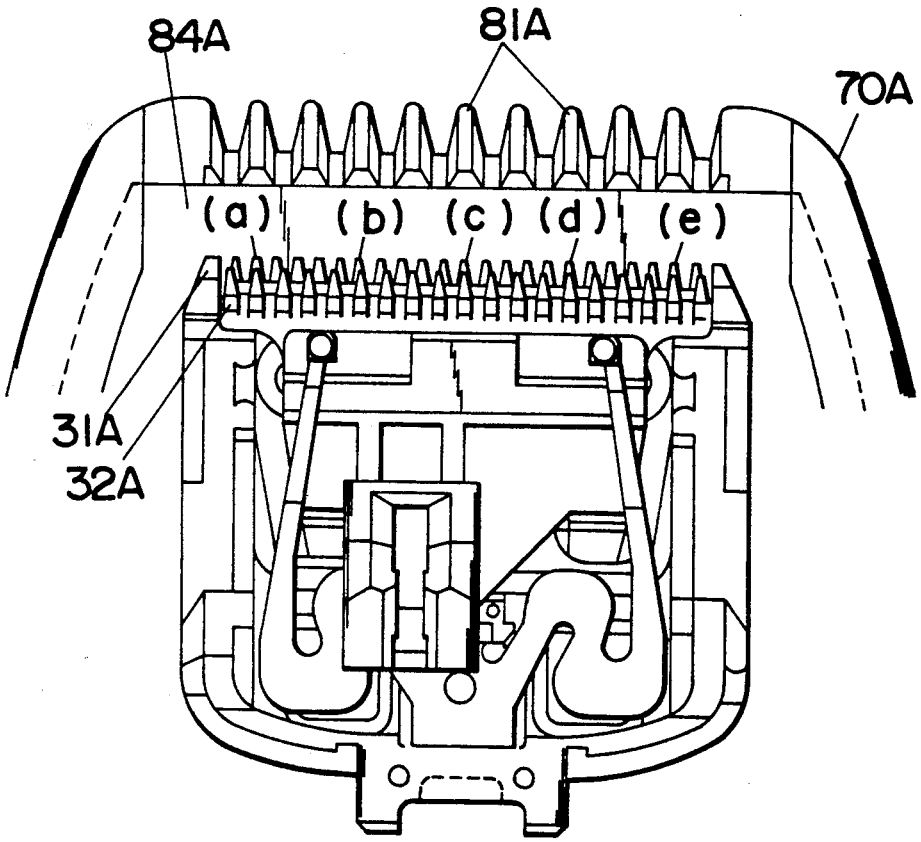
FIG. 31 is an explanatory view illustrating a relation between comb teeth formed at the front end of the base and the cutting edge.
Figure 32:
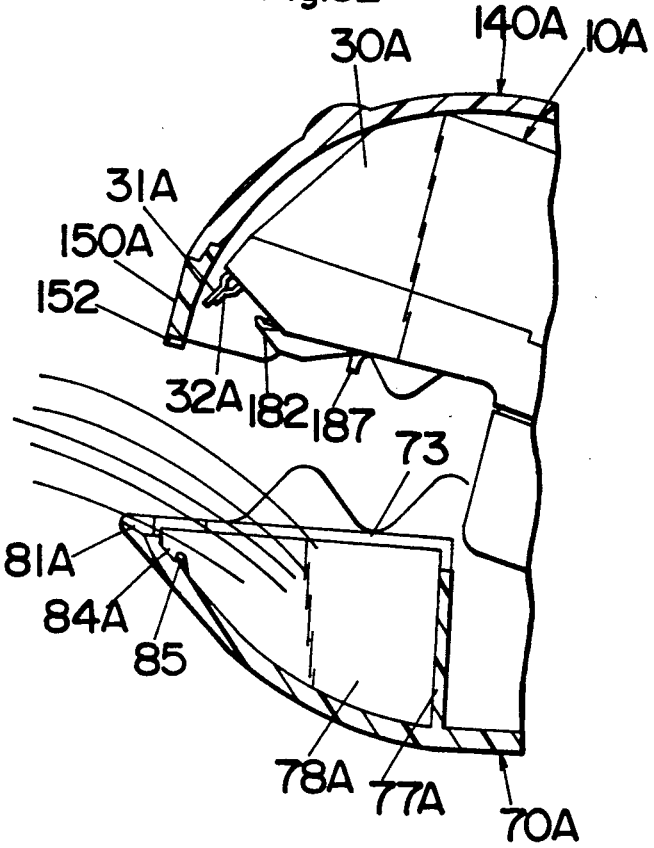
FIGS. 32 to 34 are enlarged views illustrating the cutting operation of the hair clipper.
Figure 33:
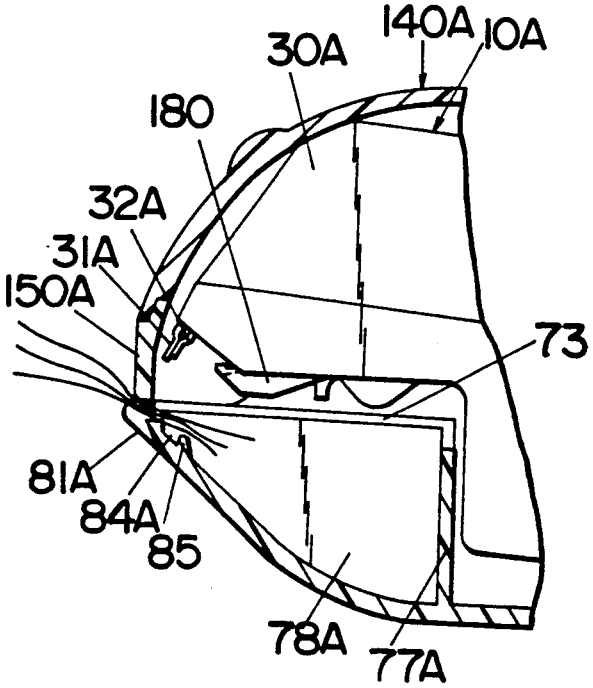
Figure 34:
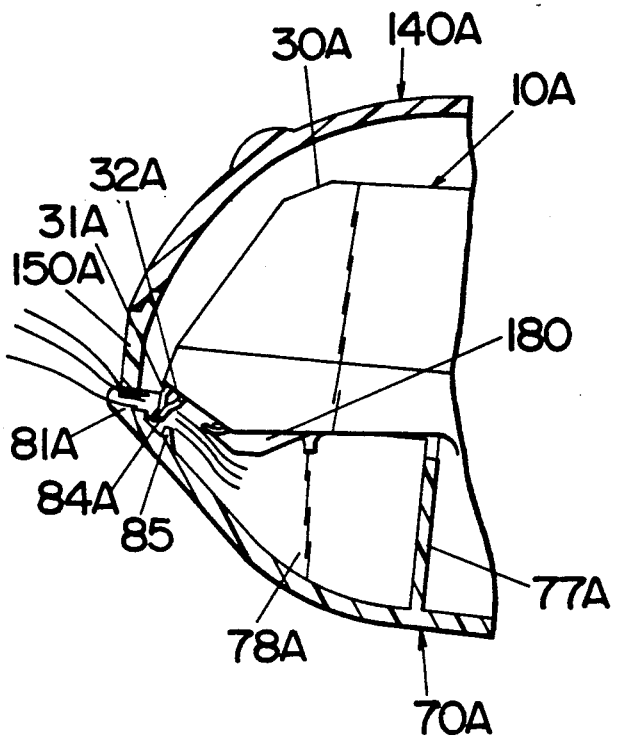

As shown in FIG. 31, the comb teeth 81A at the front edge of the base 70A are arranged to have a pitch different from that of the stationary blade 31A and also to have only some of the comb teeth 81A in alignment respectively with the teeth of the stationary blade 31A, as indicated at (a), (b), (c), (d), and (e) in the figure, at which the teeth of the movable blade 32A overlap during the reciprocation of the movable blade 32A. With this arrangement, the hairs divided between the comb teeth 81A can have an increased chance of being sheared by the cutting edge and therefore be sheared effectively.

Figure 19:
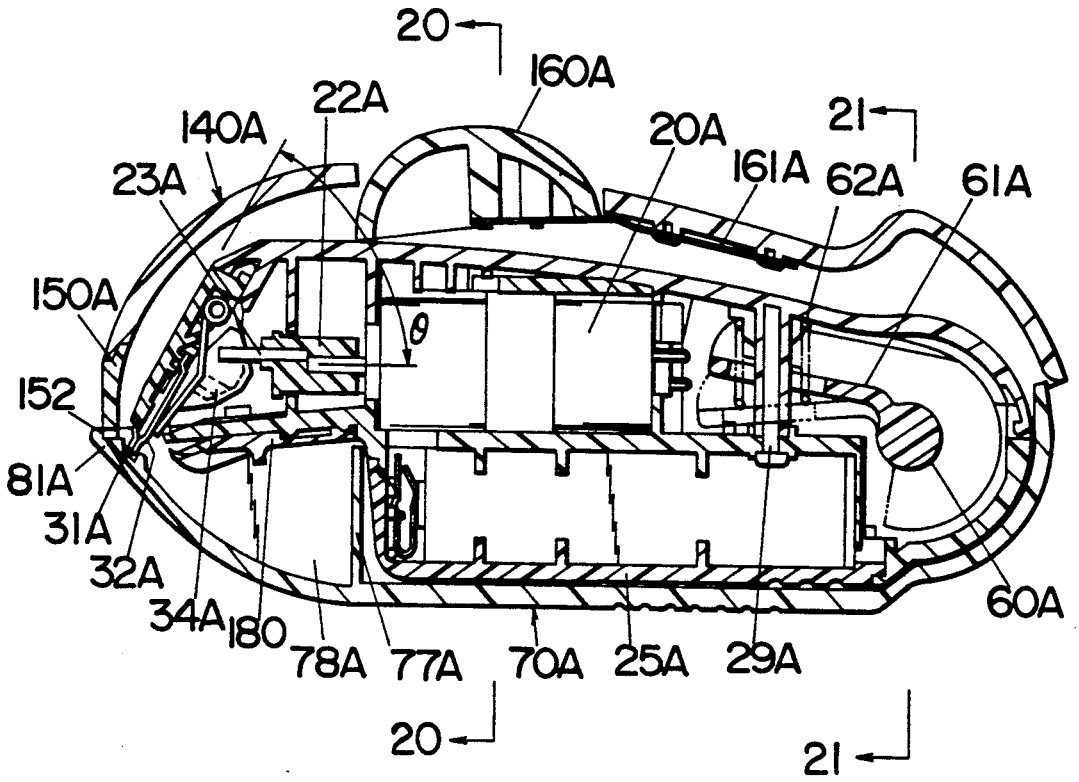
FIG. 19 is a sectional view of the hair clipper.
Figure 20:
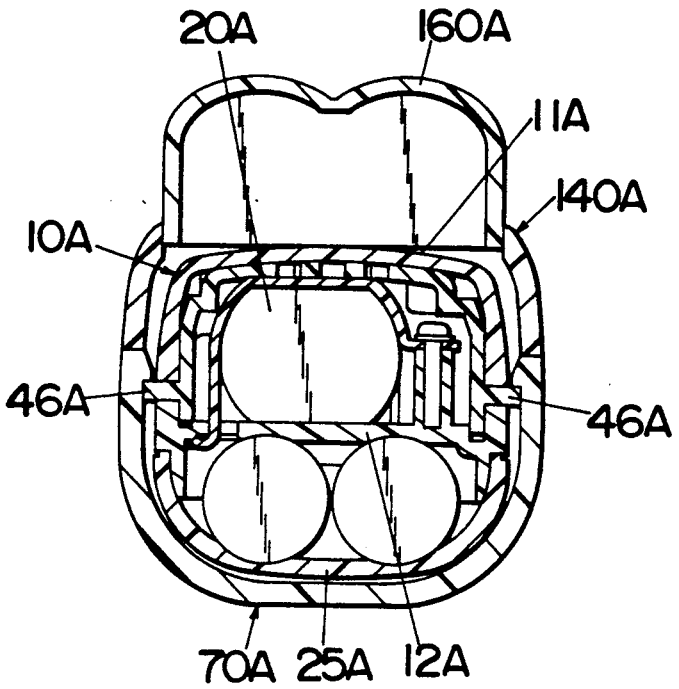
FIG. 20 is a sectional view taken along line X—X of FIG. 19.
Figure 21:
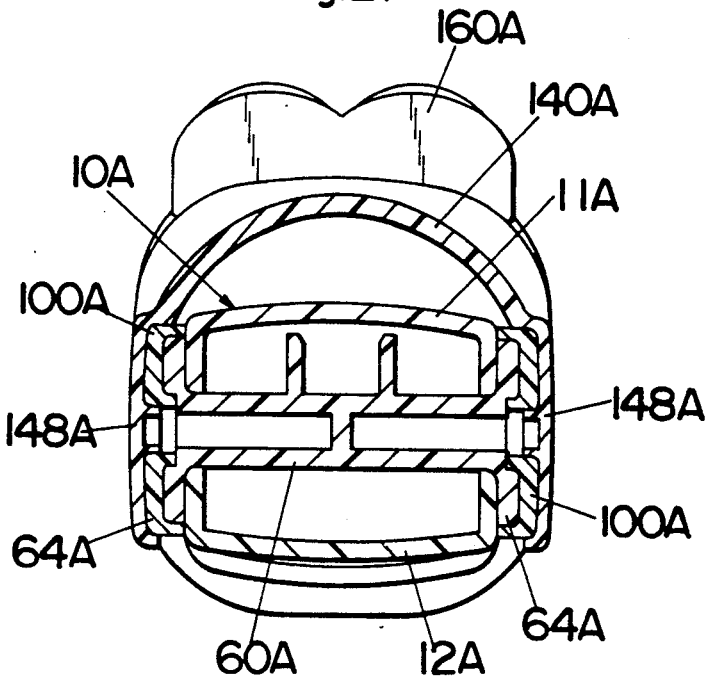
FIG. 21 is a sectional view taken along line Y—Y of FIG. 19.
Figure 28:
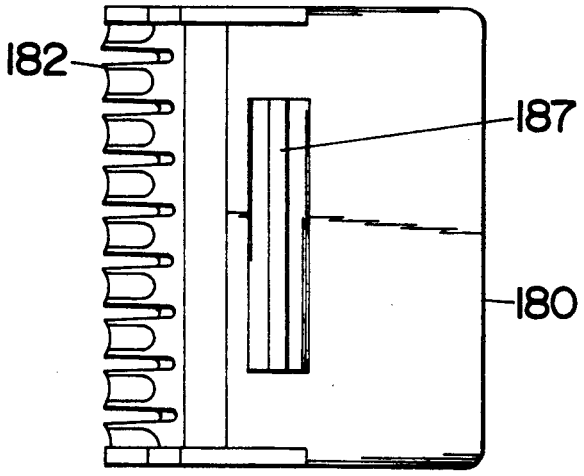
FIGS. 28 to 30 are a bottom view, a sectional view, and a top view, respectively of a hair thinning plate utilized in the hair clipper.
Figure 29:
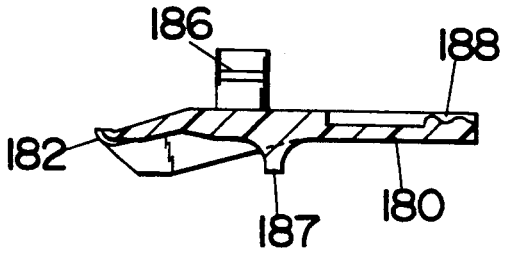
Figure 30:
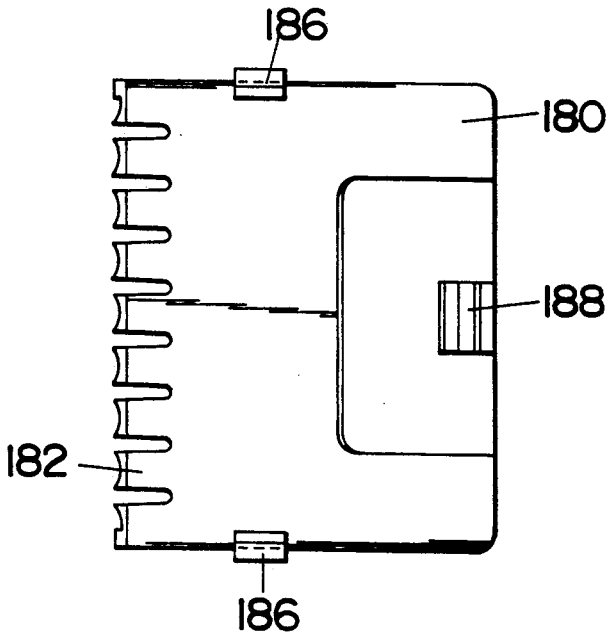
Figure 35:
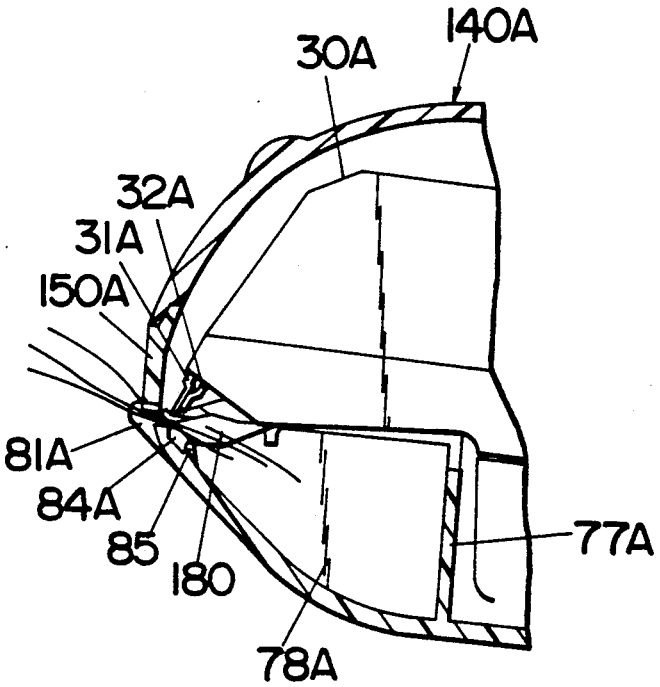
FIG. 35 is an enlarged view illustrating a hair cutting operation with the use of a hair thinning member.

The hair clipper of the present embodiment additionally includes a hair thinning plate 180 which is carried on the front bottom of the housing 10A to be slidable along the lengthwise direction of the housing 10A between an extended position and a retracted position. As shown in FIGS. 28 to 30, the hair thinning plate 180 is formed at its front edge with a row of comb-teeth 182 and at lateral ends with hooks 186 for slidably supporting the plate 180 to the housing 10A. A knob 187 on the middle of the plate 180 projects on the bottom of the housing 10A to be accessible by the user's finger. A serration 188 at the rear end of the plate 180 is engaged with a corresponding latch projection (not shown) within the housing 10A to latch the plate 180 in either of the extended or retracted position. In the retracted position, the comb-teeth 182 is concealed below the front end of the housing 10A rearwardly of the cutting edge, as shown in FIG. 19, so as not interrupt the hair shearing at the cutting edge. When the hair thinning plate 180 advances to the extended position, as shown in FIG. 35, the combteeth 182 act to conceal particular portions of the cutting edge, thus disabling those portions spaced along the length of the cutting edge to limit the amount of the hairs to be cut, i.e., to effect a hair thinning. At this condition, the hair thinning plate 180 is held against the comb teeth 81A of the base 70A with the cutting edge brought into a close relation to the comb teeth 81A for shearing the hairs by the cutting edge exposed through the comb-teeth 182 of the plate 180. As shown in FIG. 28, the comb-teeth 182 are each configured to have a rounded recess 183 in its lower surface for facilitating to smoothly guide or comb the hairs as the clipper advances over the skin of the user.

Figure 36:
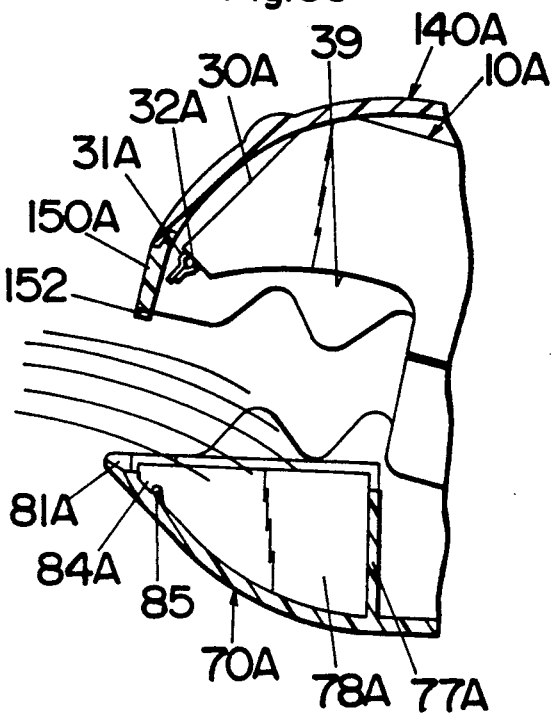
FIGS. 36 and 37 are enlarged views illustrating the like cutting operation with a modified hair clipper.
Figure 37:
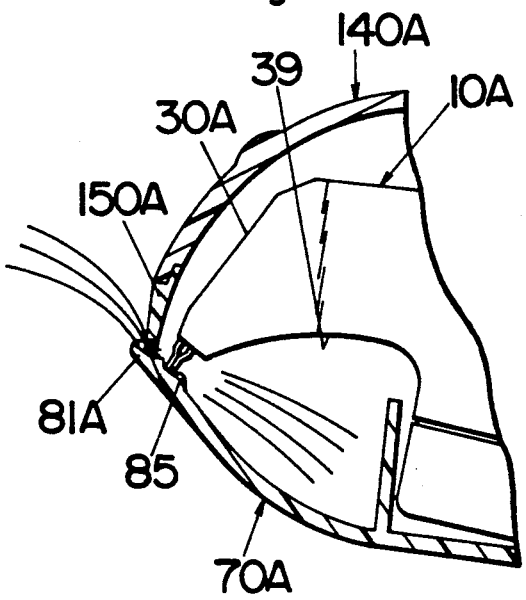

When the hair clipper is modified to have a like cutter head 30A without the hair thinning plate as shown in FIGS. 36 and 37, it is preferred to have a concave 39 in the bottom of the cutter head 30A in order to allow the hairs to extend in the concave 39, enabling to introduce the hairs along the underside of the cutter head 30A without having the tips of the hairs bent or interrupted.

Figure 38:
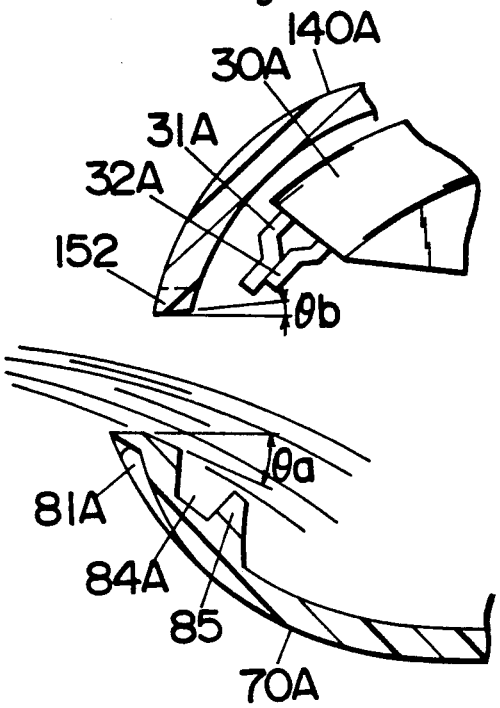
FIGS. 38 and 39 are enlarged views illustrating the like cutting operation with a another modification hair clipper.
Figure 39:
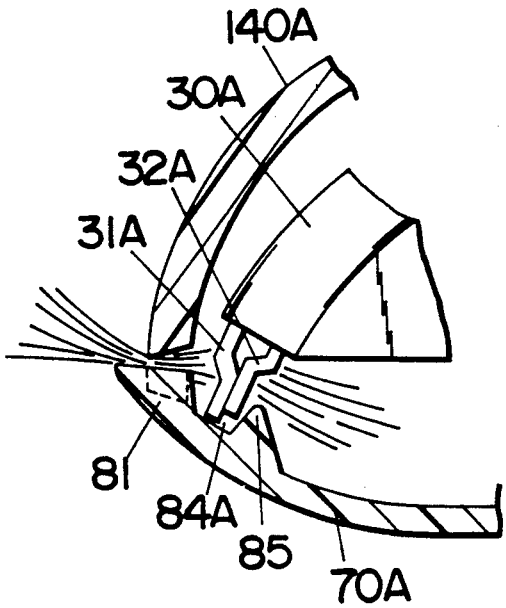

As shown in FIGS. 38 and 39, the comb teeth 81A and 152 may be configured to have the engaging faces inclined at angles of $\Theta_a$ and $\Theta_b$ to provide therebetween a gap which is greater toward the rear end or the cutting edge than at the front end. This contributes to distribute the tips of the hairs to a some extent in a direction perpendicular to the cutting edge, thereby further improving the shearing efficiency in combination with the above effect of holding the hairs between the comb teeth 81A and 152.

Figure 40:
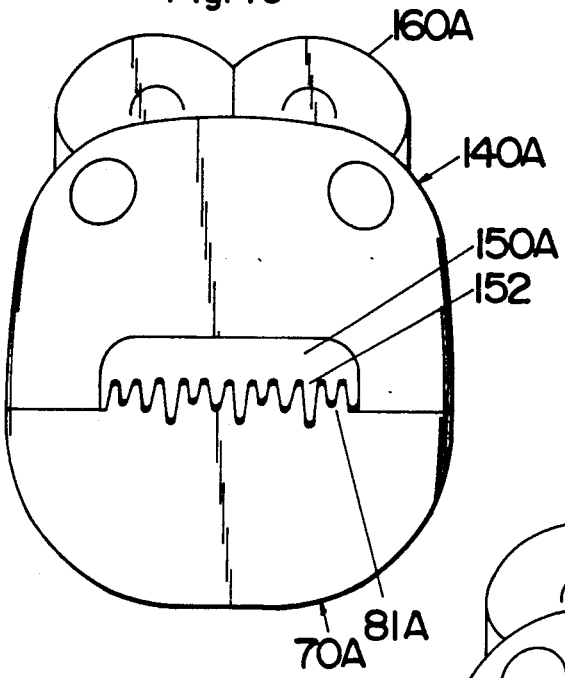
FIGS. 40 to 42 are views illustrating the front ends of further modified hair clippers, respectively.
Figure 41:
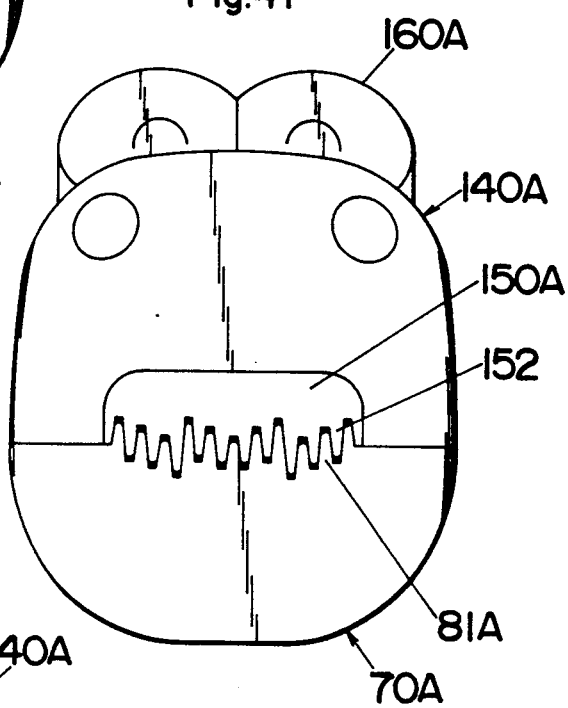
Figure 42:
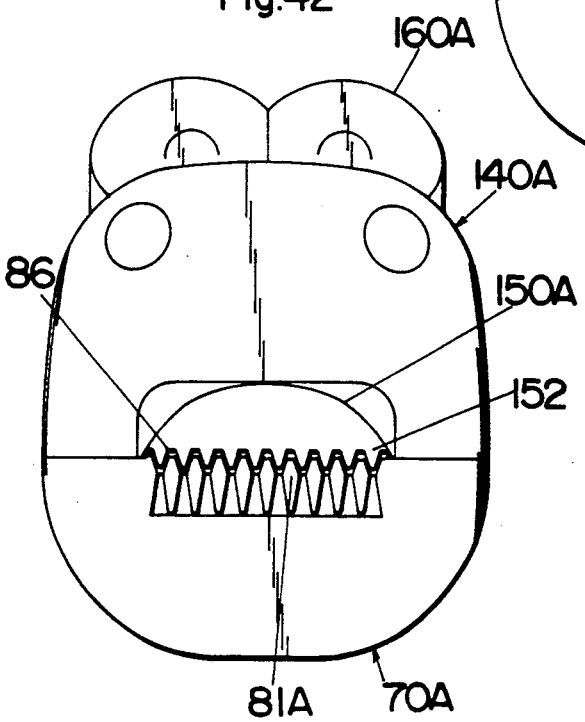

In order to distribute the hairs vertically to a greater extent for improving the shearing efficiency, the comb teeth 81A of the base 70A and the corresponding comb teeth 152 of the Cover may be modified such that the comb teeth 81A are configured to have differing teeth depths, as shown in FIG. 40 or the comb teeth 81A are configured to have different teeth depths as well as heights, as shown in FIG. 41.

Figure 43:
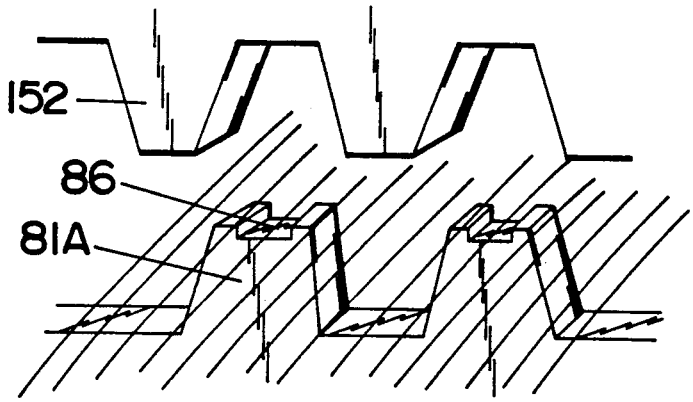
FIGS. 43 and 44 are schematic views illustrating the operation effected by the modified hair clipper of FIG. 42.
Figure 44:
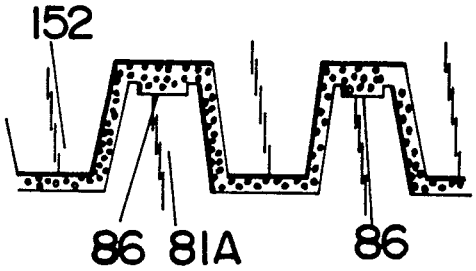

Further, the comb teeth 81A may be formed in their top ends with dimples 86, as shown in FIGS. 43 and 44, so as to positively and securely seize the hairs therein for preventing the hairs from being slid to the bottom of the teeth during the cutting operation, thereby facilitating to cut the hairs smoothly and effectively as described hereinbefore.

Figure 45:
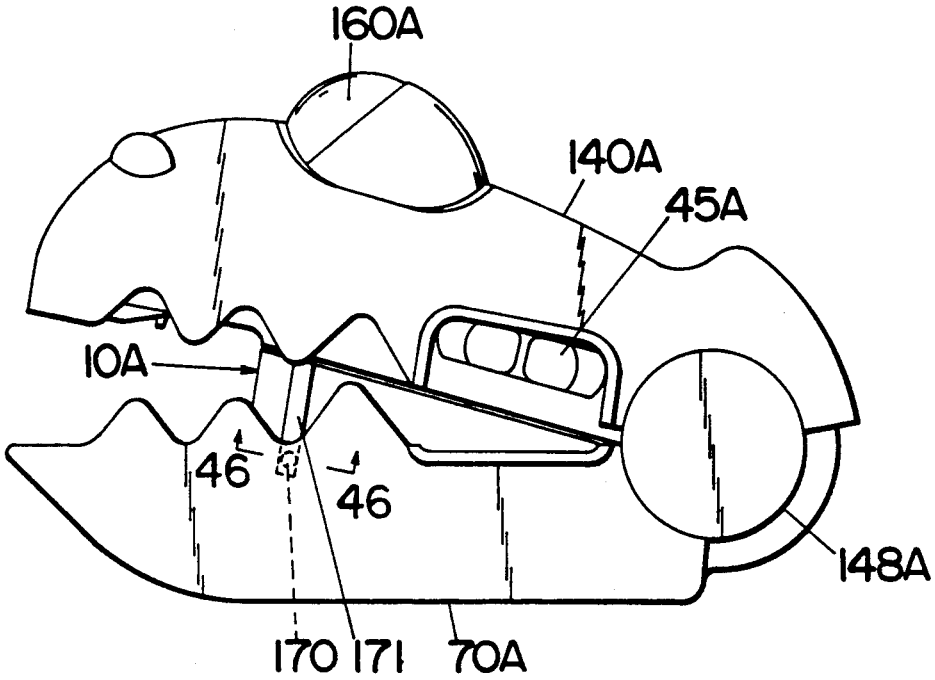
FIG. 45 is a front view of a still further modified hair clipper.
Figure 46:
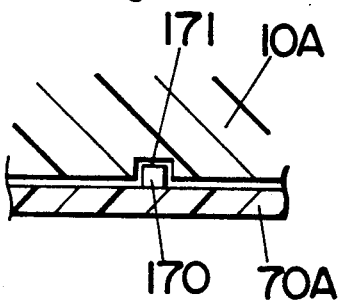
FIG. 46 is a sectional view taken along line Z—Z of FIG. 45.
Figure 47:
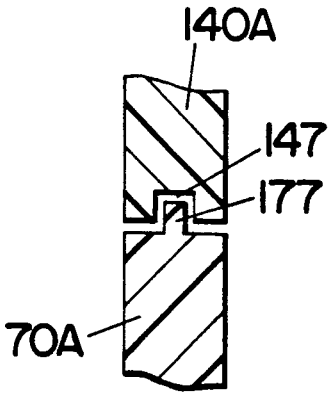
FIG. 47 is a sectional view of an engagement between a cover and a base of the hair clipper of FIG. 45.

To avoid fluttering of the base 70A horizontally relative to the housing 10A and the cover 140A, the base 70A may be provided with guide posts 170 which are slidably engaged into corresponding slots 171 in the opposite sides of the housing 10A, as shown in FIGS. 45 and 46. Alternately or in addition to the above, the base 70A may be formed on its upper face with a tongue 177 engageable into a corresponding groove 147 formed in the lower end face of the cover 140A.

What is claimed is:

1. A hair clipper comprising:

an elongated housing, having a forward and rear end, formed at its forward end with a cutter head, said cutter head comprising a stationary blade with a toothed edge and a movable blade with a toothed edge, said movable blade being driven to reciprocate relative to said stationary blade in hair shearing engagement between the toothed edges of said stationary and movable blades, said toothed edge of the stationary cutter defining a cutting edge;

an elongated base, having a forward and rear end, formed at its forward end with a hair entrapping member, said hair entrapping member extending generally parallel to said cutting edge and movable relative to said cutting head between an open position where said elongated base is spaced from said cutting edge of said cutter head and a closed position where said elongated base is held in close proximity with said cutting edge, said hair entrapping member allowing hairs to extend past said cutting edge in said open position and seizing said hairs between said cutting edge and said hair entrapping member in said closed position for shearing said hairs by cooperation of said movable and stationary blades said housing being urged toward said open position by first spring means interposed between said housing and said base;

an elongated cover, having a forward and rear end, formed at its forward end with a hair pressing member, said hair pressing member being opposed to said hair entrapping member and located in an offset relation to said cutting edge and movable between a pressing position where said elongated cover comes in contact with said hair entrapping member to press the hairs forwardly of said cutting edge and a release position where said elongated cover is spaced away from said hair entrapping member, said hair pressing member being interrelated with said hair entrapping member such that said hair pressing member comes into said pressing position before said cutting edge comes into said closed position, whereby the hairs are pressed against the hair pressing member prior to being sheared by said cutting edge;

said elongated housing, said elongated base, and said elongated cover being pivotally connected to each other at the rear ends thereof such that said housing and said cover are movable relative to said base respectively between said closed and open positions and between said pressing and release positions;

said cover overlapping said housing in an abuttable relation thereto so that said cover is urged to said release position by said first spring means, said cover carrying second spring means which is disposed in an abuttable relation to the housing and is accessible by a user, said second spring means being displaceable relative to said cover in a direction of moving said housing toward said closed position against the bias of said second spring means plus that of said first spring means, said second spring means exerting a spring bias greater than said first spring means for facilitating movement of said hair pressing member into said pressing position before moving said cutting edge into said closed position relative to said hair entrapping member.

2. A hair clipper as set forth in claim 1, wherein said second spring means is secured at its one end to said cover with the other end of said second spring means in abuttable relation to said housing such that said cover is movable relative to said housing to a limited extent, said second spring means carrying a push button which projects through a window formed in said cover to be accessible by the user such that, when said push button is pressed, said cover is firstly caused to move relative to said base independently of said housing for bringing said hair pressing member into said pressing position, after which the housing is caused to move toward the base against the bias of said first spring means for bringing said hair entrapping member into said closed position.

3. A hair clipper as set forth in claim 1, wherein said hair entrapping member is formed with an array of comb teeth which is located forwardly of an engaging portion of said hair entrapping member with said cutting edge, for smoothening the hairs over the length of said comb teeth prior to shearing the hairs at said cutting edge.

4. A hair clipper as set forth in claim 3, wherein said hair pressing member includes an array of comb teeth in meshing engagement with the array of comb teeth of said hair entrapping member.

5. A hair clipper as set forth in claim 3, wherein said array of comb teeth of said hair entrapping member has a tooth pitch different from that of said cutting edge.

6. A hair clipper as set forth in claim 3, wherein said comb teeth of said hair entrapping member are provided in the top ends thereof with recesses.

7. A hair clipper as set forth in claim 3, wherein said comb teeth extend over a limited distance in a direction perpendicular to the cutting edge, said comb teeth having the end faces inclined in such a manner as to leave between said hair pressing member and said hair entrapping member a gap which is greater toward the cutting edge than at the leading edge of said hair entrapping member.

8. A hair clipper as set forth in claim 1, wherein a push button is connected to said cover through second spring means.

9. A hair clipper comprising:

an elongated housing, having a forward and rear end, formed at its forward end with a cutter head, said cutter head comprising a toothed stationary blade and a toothed movable blade which is driven to reciprocate relative to said stationary blade in hair shearing engagement therebetween;

an elongated base, having a forward and rear end, formed at its forward end with a hair entrapping member, said hair entrapping member extending generally parallel to said cutting edge and movable relative to said cutting head between an open position where said elongated base is spaced from said cutting edge of said cutter head and a closed position where said elongated base is held in close proximity with said cutting edge, said hair entrapping member allowing hairs to extend past said cutting edge in said open position and seizing said hairs between said cutting edge and said hair entrapping member in said closed position for shearing said hairs by cooperation of said movable and stationary blades, said housing being urged toward said open position by spring means interposed between said housing and said base;

an elongated cover, having a forward and rear end, formed at its forward end with a hair pressing member, said hair pressing member being opposed to said hair entrapping member and located in an offset relation to said cutting edge and movable between a pressing position where said elongated cover comes in contact with said hair entrapping member so as to press the hairs forwardly of said cutting edge and a release position where said elongated cover is spaced away from said hair entrapping member, said hair pressing member being interrelated with said hair entrapping member such that said hair pressing member comes into said pressing position before said cutting edge comes into said closed position, whereby the hairs are pressed against the hair pressing member prior to being sheared by said cutting edge;

said elongated housing, base, and cover being pivotally connected to each other at the rear ends thereof such that said housing and said cover are movable relative to said base respectively between said closed and open positions and between said pressing and release positions;

said cover overlapping said housing in an abuttable relation thereto so that said cover is urged to said release position by said spring means, said cover carrying a push button which is accessible by a user and displaceable relative to said cover over a limited distance in an abuttable relation to said housing in a direction of moving said housing toward said closed position against the bias of said spring means while allowing said cover to move said hair pressing member into said pressing position before moving said cutting edge into said closed position relative to said hair entrapping member.

10. A hair clipper as set forth in claim 9, wherein said hair pressing member is made of a transparent material through which the engagement of the hairs between said cutting edge and said hair entrapping member can be viewed.

11. A hair clipper as set forth in claim 9, wherein said hair pressing member is positioned closely adjacent to said cutting edge.

12. A hair clipper as set forth in claim 9, wherein said hair pressing member is supported on a member which surrounds said cutting edge for preventing the clipped hairs from spreading outwardly.

13. A hair clipper as set forth in claim 9, wherein said comb teeth are configured to vary at least one of the tooth height or a depth of a groove formed between the teeth.

* * * * *